US008657427B2

(12) United States Patent
Matsumoto

(10) Patent No.: US 8,657,427 B2
(45) Date of Patent: Feb. 25, 2014

(54) LIQUID CONTAINER

(71) Applicant: Seiko Epson Corporation, Tokyo (JP)

(72) Inventor: Akihito Matsumoto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/715,397

(22) Filed: Dec. 14, 2012

(65) Prior Publication Data

US 2013/0180877 A1 Jul. 18, 2013

(30) Foreign Application Priority Data

Dec. 16, 2011 (JP) ..... 2011-275914

(51) Int. Cl.
*B41J 2/175* (2006.01)

(52) U.S. Cl.
USPC ..... 347/86

(58) Field of Classification Search
USPC ..... 347/84–86
See application file for complete search history.

(56) References Cited

U.S. PATENT DOCUMENTS

| | | | | |
|---|---|---|---|---|
| 5,381,172 | A | 1/1995 | Ujita et al. | |
| 6,345,889 | B1 * | 2/2002 | Sakuraoka et al. | 347/86 |
| 6,609,789 | B1 * | 8/2003 | Hunt | 347/86 |
| 6,830,323 | B2 * | 12/2004 | Perkins et al. | 347/86 |
| 7,018,029 | B2 * | 3/2006 | Ishizawa et al. | 347/86 |
| 7,029,104 | B2 * | 4/2006 | Sakai et al. | 347/86 |
| 7,048,348 | B2 * | 5/2006 | Mochizuki et al. | 347/85 |
| 2001/0017640 | A1 * | 8/2001 | Inada et al. | 347/84 |
| 2006/0038865 | A1 * | 2/2006 | Nagasaki et al. | 347/86 |
| 2006/0221152 | A1 | 10/2006 | Katada | |
| 2009/0290001 | A1 | 11/2009 | Domae | |

FOREIGN PATENT DOCUMENTS

| | | | |
|---|---|---|---|
| JP | 10-114082 | A | 5/1998 |
| JP | 3115660 | B2 | 12/2000 |
| JP | 2001-232812 | A | 8/2001 |
| JP | 2003-145785 | A | 5/2003 |
| JP | 2003-320677 | A | 11/2003 |
| JP | 2006-069051 | A | 3/2006 |
| JP | 2006-089687 | A | 4/2006 |
| JP | 2006-198873 | A | 8/2006 |
| JP | 2006-231669 | A | 9/2006 |
| JP | 2006-272902 | A | 10/2006 |
| JP | 2007-083497 | A | 4/2007 |
| JP | 2009-226726 | A | 10/2009 |
| JP | 2009-279876 | A | 12/2009 |
| WO | WO-2006/019034 | A1 | 2/2006 |

OTHER PUBLICATIONS

International Search Report for the corresponding International Application No. PCT/JP2012/008010 dated Jan. 15, 2013.

* cited by examiner

*Primary Examiner* — Kristal Feggins
(74) *Attorney, Agent, or Firm* — Global IP Counselors, LLP

(57) ABSTRACT

The environmental burden of a liquid container during its life cycle is reduced, and a decrease in the reading or writing precision of an information recording unit provided on the liquid container is suppressed. A liquid container mounted in a liquid container holder of a liquid consuming apparatus, equipped with a first container section enclosing at least a portion of a liquid containing space capable of containing a liquid, the material thereof including a plant derived material, a high rigidity member having higher rigidity than the first container section, the material thereof including a material different from the plant derived material, and an information recording unit positioned above the high rigidity member, in which information relating to the liquid container is recorded, for which the information is read or written by a reading unit or a writing unit provided on the liquid consuming apparatus.

15 Claims, 15 Drawing Sheets

LIQUID CONTAINER

CROSS-REFERENCE TO RELATED APPLICATION

This application claims priority on the basis of Japanese Patent Application No. 2011-275914 filed on Dec. 16, 2011, and this application is incorporated in this specification by reference.

BACKGROUND

1. Technical Field

The present invention relates to a liquid container where it is possible for a liquid to be contained.

2. Related Art

Ink jet printers, which record images or text by ejecting ink onto a print medium from a plurality of nozzles which are provided in a print head, are widely used. In the ink jet printers, an ink cartridge containing ink is mounted in a holder and ink is supplied to the print head from the ink cartridge.

In the life cycle from the manufacturing to the disposal of the ink cartridge, it is desirable to reduce the burden on the environment as much as possible. In the past, there have been known ink cartridges with a configuration in which an ink pack which is formed by a thermoplastic film material is contained in an outer box which is formed of paper and ink cartridges with a configuration in which a so-called gusset type ink pack is contained in a cartridge case which is formed of paper (see Patent Documents 1 and 2, for example).

Patent Document 1: Unexamined Patent Publication No. 2006-69051

Patent Document 2: Unexamined Patent Publication No. 2009-226726

With the aforementioned ink cartridge, the outer box or the like is formed using a plant derived material such as paper rather than a resin material such as plastic, so it is possible to reduce the environmental burden during its life cycle. On the other hand, when the outer box or the like is formed using a plant derived material such as paper, when an information recording unit in which information relating to the ink cartridge is recorded is provided, and information is read or written by reading means or writing means provided on the printer, there are cases when the reading or writing precision decreases.

Here, such problems are in common with a liquid container which is adapted to be mounted in a liquid container holder of a liquid consuming apparatus without being limited to ink cartridges which are mounted in a holder of an ink jet printer.

SUMMARY

The invention has been made to solve at least a portion of the problems described above, and realization in the below modes or application examples is possible.

A liquid container configured to be mounted in a liquid container holder of a liquid consuming apparatus, comprising a first container section enclosing at least a portion of a liquid containing space capable of containing a liquid, the material thereof including a plant derived material; a high rigidity member having higher rigidity than the first container section, the material thereof including a material different from the plant derived material, and an information recording unit positioned above the high rigidity member, in which information relating to the liquid container is recorded, for which the information is read or written by reading means or writing means provided on the liquid consuming apparatus.

With this liquid container, the container section enclosing the liquid containing space capable of containing liquid is formed using a plant derived material, so it is possible to reduce the environmental burden of the liquid container during its life cycle. Also, with this liquid container, the information recording unit is provided above the high rigidity member which contains a material different from the material of the first container section and also has higher rigidity than the first container section. By doing this, skewing of the relative positional relationship of the reading means or writing means provided on the liquid consuming apparatus and the information recording unit is suppressed. As a result, it is possible to achieve an improvement in the precision when reading the information recording unit using the reading means or writing to the information recording unit using the writing means (suppressing the occurrence of misreading or miswriting).

The liquid container according to application example 1, further including a second container section having the liquid containing space internally, formed by a flexible sheet, and enclosed by the first container section.

With this liquid container, ink is contained in the liquid containing space inside the second container section for which at least a portion is formed using a flexible sheet, so it is possible to suppress the occurrence of liquid leaks. Also, the first container section that encloses the second container section is formed using a plant derived material, so it is possible to reduce the environmental burden of the liquid container during its life cycle.

The liquid container according to application example 1, wherein the information is capable to be written to the information recording unit in a state with the writing means in contact with the information recording unit.

When the information is written in a state with the writing means in contact with the information recording unit, the risk of miswriting increases. However, with this liquid container, since the information recording unit is positioned above the high rigidity member, even in such a case, it is possible to achieve an increase in the information recording unit writing precision.

The liquid container according to application example 1, wherein the high rigidity member is a flow path member having a supply port for supplying liquid contained in the liquid containing space to the liquid consuming apparatus, and having a flow path that links the liquid containing space and the supply port.

With this liquid container, the flow path member having a supply port for supplying liquid contained in the liquid containing space to the liquid consuming apparatus, and having a flow path that links the liquid containing space and the supply port function as the high rigidity member. Because of that, compared to when the high rigidity member on which the information recording unit is positioned is provided separately from the flow path member, it is possible to simplify the structure and to realize a reduction in the environmental burden. It is also possible to form the supply port or the flow path on the relatively high rigidity flow path member, and to suppress the occurrence of problems such a liquid leaks and the like.

The liquid container according to application example 1, further comprising a flow path member having a supply port for supplying liquid contained in the liquid containing space to the liquid consuming apparatus, and having a flow path that links the liquid containing space and the supply port, the flow path member being coupled to the high rigidity member.

With this liquid container, the high rigidity member is coupled to the flow path member having a supply port for supplying liquid contained in the liquid containing space to the liquid consuming apparatus, and having a flow path that links the liquid containing space and the supply port. Because the information storage unit is positioned on this high rigidity member, the skew of the relative positional relationship of the reading means or writing means with the information recording unit is suppressed to a minimum. It is also possible to achieve an improvement in the reading and writing precision of the information recording unit. It is also possible to suppress the occurrence of problems such as liquid leaks and the like by forming the supply port or flow path on the flow path member having relatively high rigidity.

The liquid container according to application example 5, wherein the liquid container includes a first surface and a second surface different from the first surface, and the high rigidity member is positioned on the first surface, and the flow path forming member is positioned on the second surface.

With this liquid container, the high rigidity member and the flow path member are arranged across a first surface of the liquid container and a second surface different from the first surface, so it is possible to suppress to a minimum the skew of the relative positional relationship of the reading means or writing means with the information recording unit, and to achieve an improvement in the reading and writing precision of the information recording unit. It is also possible to suppress the occurrence of problems such as liquid leaks or the like by forming the supply port or flow path on the flow path member with relatively high rigidity.

The liquid container according to application example 6, wherein the coupling part of the high rigidity member and the flow path member is thinner than the high rigidity member and the flow path member adjacent to the coupling part.

With this liquid container, it is possible to more easily perform fixing or detaching of the container section in relation to the flow path member and the high rigidity member. It is also possible to easily position the information recording unit on the high rigidity member.

The liquid container according to application example 1, wherein the liquid container includes a first surface and a second surface different from the first surface, and the information recording unit is positioned at the first surface, and the first surface is exposed when the liquid container is mounted in the liquid container holder.

With this liquid container, the information recording unit is arranged on the surface that is exposed when the liquid container is mounted in the liquid container holder, so even in a state with the liquid container mounted in the liquid container holder, it is possible to check the state of the information recording unit (for example the presence or absence of dirt or peeling).

The liquid container according to application example 1, including a flow path member having a supply port for supplying liquid contained in the liquid containing space to the liquid consuming apparatus, and having a flow path that links the liquid containing space and the supply port, wherein the liquid container includes a first surface and a second surface facing opposite the first surface, and the supply port is positioned on the first surface, and the information recording unit is positioned on the second surface.

With this liquid container, the information recording unit is arranged on the surface facing opposite the surface on which the supply port of the flow path member is provided, so even if liquid leaks from the supply port, it is possible to suppress damage and soiling of the information recording unit by the liquid.

The liquid container according to application example 1, wherein the high rigidity member has a liquid container side engagement section that is engaged with an apparatus side engagement section provided on the liquid consuming apparatus to fix the liquid container to the liquid container holder.

With this liquid container, it is possible to stably fix the liquid container to the liquid container holder while achieving an improvement in the reading and writing precision of the information recording unit.

The liquid container according to application example 1, wherein the high rigidity member has a liquid container side engagement section that is engaged with an apparatus side engagement section provided on the liquid consuming apparatus to align the liquid container with the liquid container holder.

With this liquid container, it is possible to align the liquid container with the liquid container holder with good precision while achieving an improvement in the reading and writing precision of the information recording unit.

The invention can be realized in various modes, and for example, it is possible to realize modes such as a liquid container, a manufacturing method of the liquid container, a liquid consuming apparatus equipped with the liquid container and the like.

DETAILED DESCRIPTION OF THE PREFERRED EMBODIMENTS

Next, we will describe embodiment of the invention in the following sequence based on working examples.

A. First Working Example:
  A-1. Printer Configuration:
  A-2. Ink Cartridge Configuration:
  A-3. First Working Example Modified Example:
B. Second Working Example:
  B-1. Printer Configuration:
  B-2. Ink Cartridge Configuration:
  B-3. Second Working Example Modified Example:
C. Other Modified Examples:

A. FIRST WORKING EXAMPLE

A-1. Printer Configuration

Figure 1:
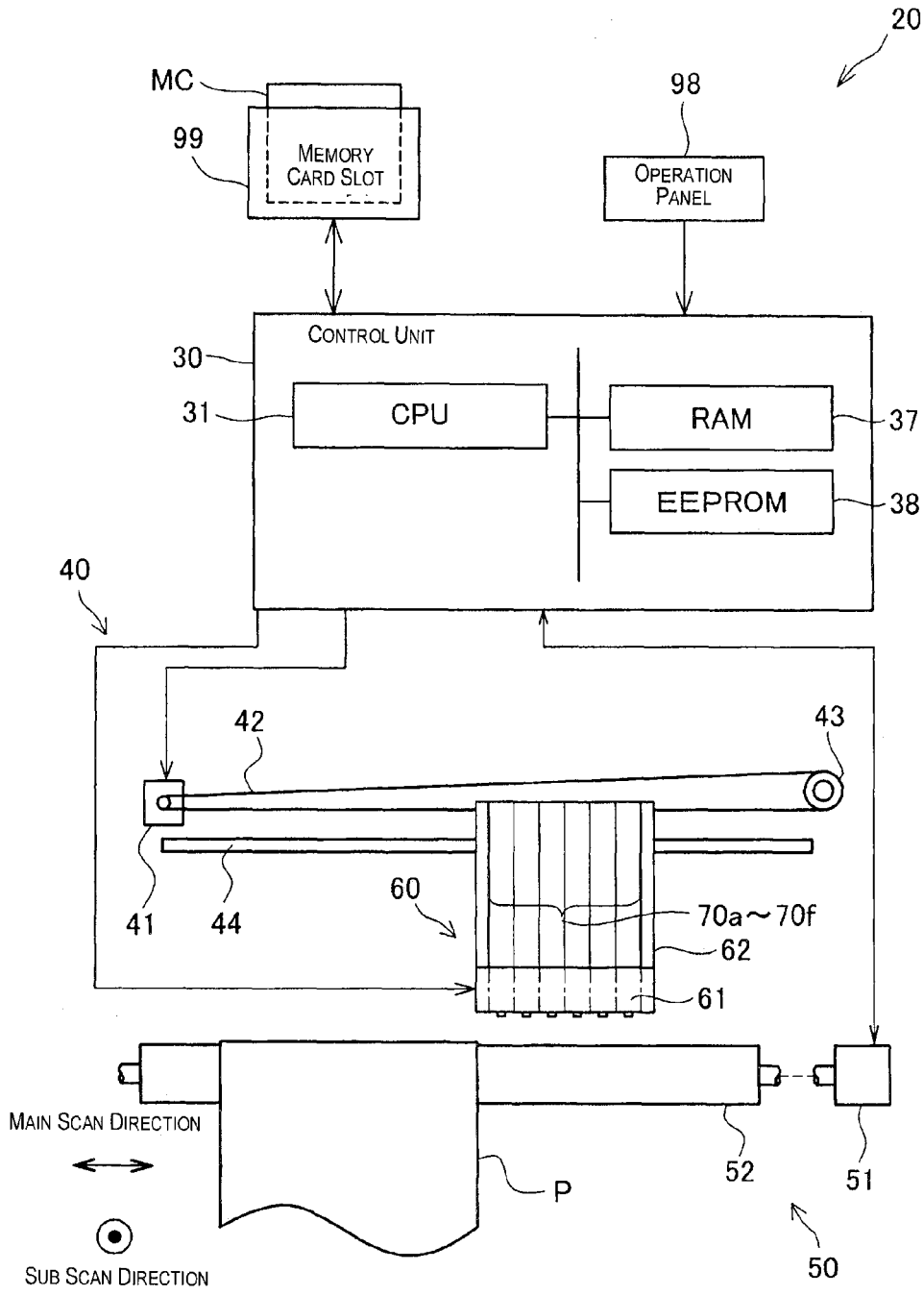
FIG. 1 is an explanatory diagram illustrating a schematic configuration of a printer 20 in a first working example of the invention.

FIG. 1 is an explanatory diagram illustrating the schematic configuration of the printer 20 of the first working example. The printer 20 in the present working example is an ink jet printer which forms ink dots on a print medium by ejecting ink from a plurality of nozzles, and thereby records characters, graphics, images or the like on the print medium. The printer 20 is one liquid consuming apparatus which consumes ink as a liquid.

As shown in FIG. 1, the printer 20 is provided with a print head unit 60 on which a print head 61 is mounted, a print head unit transport mechanism 40 which performs main scanning in which the print head unit 60 is moved back and forth along a direction which is parallel to a shaft of a platen 52, a paper transport mechanism 50 which performs sub-scanning in which a paper sheet P as a print medium is transported in a direction (sub-scanning direction) which intersects with the main scanning direction, an operation panel 98 which receives various instructions and setting operations relating to printing, a memory card slot 99 which is able to connect to a memory card MC which is a storage medium, and a control unit 30 which controls each of the sections of the printer 20.

The paper transport mechanism 50 has a motor 51. The rotation of the motor 51 is transmitted to a paper sheet transport roller (not shown) through a gear train (not shown), and the paper sheet P is transported along the sub-scanning direction by the rotation of the paper sheet transport roller.

The print head unit transport mechanism 40 has a motor 41, a pulley 43 which stretches an endless driving belt 42 to the motor 41, and a shaft 44 which is constructed in parallel to the shaft of the platen 52 and which holds the print head unit 60 so as to be able to slide. The rotation of the motor 41 is transmitted to the print head unit 60 through the driving belt 42. Due to this, the print head unit 60 is moved back and forth along the shaft 44.

A plurality of ink cartridges 70 (70*a* to 70*f*) are mounted in a holder 62 of the print head unit 60 as liquid containers which respectively contain inks of predetermined colors (for example, cyan (C), light cyan (Lc), magenta (M), light magenta (Lm), yellow (Y), and black (K)). Here, in the following description, the plurality of ink cartridges 70*a* to 70*f* are also simply referred to as the ink cartridges 70. In the present working example, the ink cartridges 70 are mounted in the holder 62 from above in the direction of gravity. The ink which is contained in the ink cartridges 70 which are mounted in the holder 62 is supplied to the print head 61. The print head 61 has a plurality of nozzles which eject ink, and nozzle actuators (for example, piezoelectric elements) which are provided to correspond to each of the nozzles. If the nozzle actuators are driven by a predetermined driving signal, a vibrating plate inside a cavity (pressure chamber) which links with the nozzles is displaced and a pressure change is generated inside the cavity. The ink is ejected from the corresponding nozzles according to the pressure change.

The control unit 30 includes a CPU 31 which executes various types of calculation processes, a RAM 37 which temporarily stores and develops programs and data, and an EEPROM 38 which stores programs and the like which are executed by the CPU 31. The various types of functions of the control unit 30 are realized by the CPU 31 developing and executing the programs which are stored in the EEPROM 38 using the RAM 37. Here, at least a portion of the functions of the control unit 30 may be realized by operating an electrical circuit which is provided in the control unit 30 based on the circuit configuration thereof.

In the printer 20 which is configured in this manner, since printing is performed based on print target data which is input through the memory card slot 99, the control unit 30 performs control of each section of the printer 20 in accordance with instructions from the user through the operation panel 98. Due to this, the main scanning in which the print head unit 60 is moved back and forth while ink is ejected from the nozzles and the sub-scanning in which the paper sheet P is transported in the sub-scanning direction are repeatedly executed and the recording of an image or the like on the paper sheet P is realized.

A-2. Ink Cartridge Configuration

Next, the configuration of the ink cartridge 70 in the present working example will be described. As described above, in the printer 20 of the present working example, six ink cartridges 70 (70*a* to 70*f*) are mounted in the holder 62, but the configuration of each of the ink cartridges 70 is basically the same.

Figure 2:
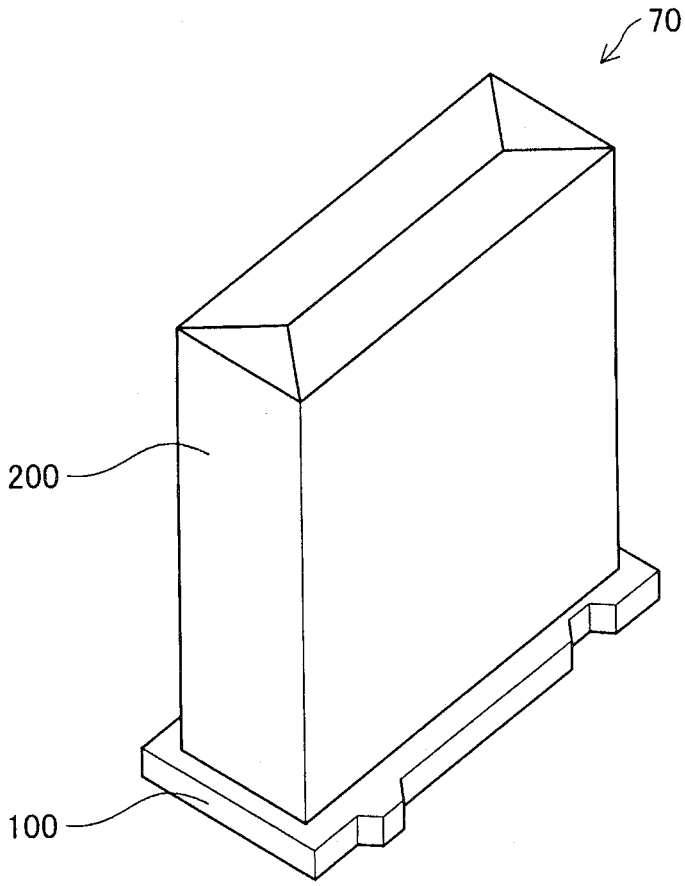
FIG. 2 is an explanatory diagram illustrating a basic configuration of an ink cartridge 70.
Figure 3:
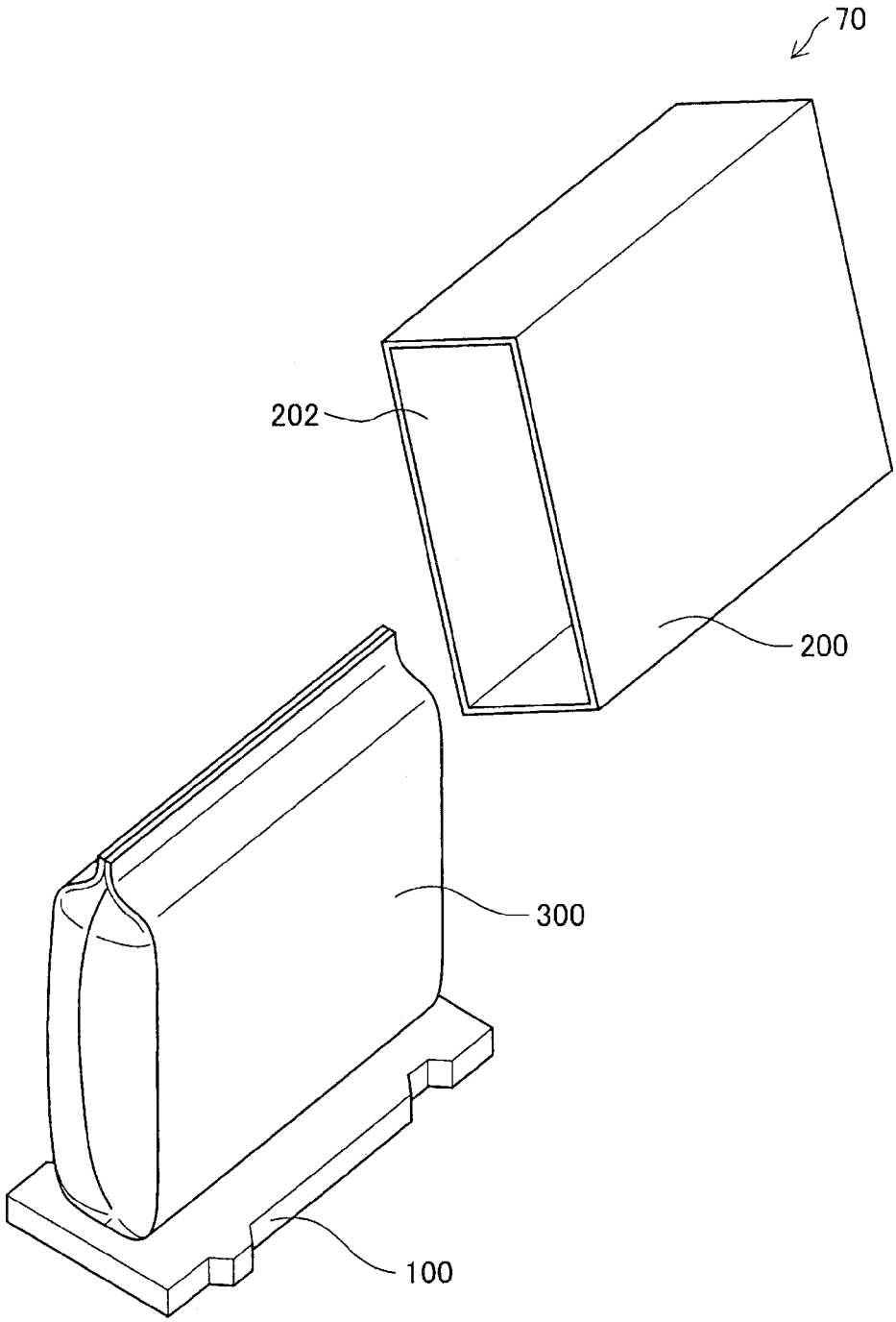
FIG. 3 is an explanatory diagram illustrating a basic configuration of the ink cartridge 70.
Figure 4:
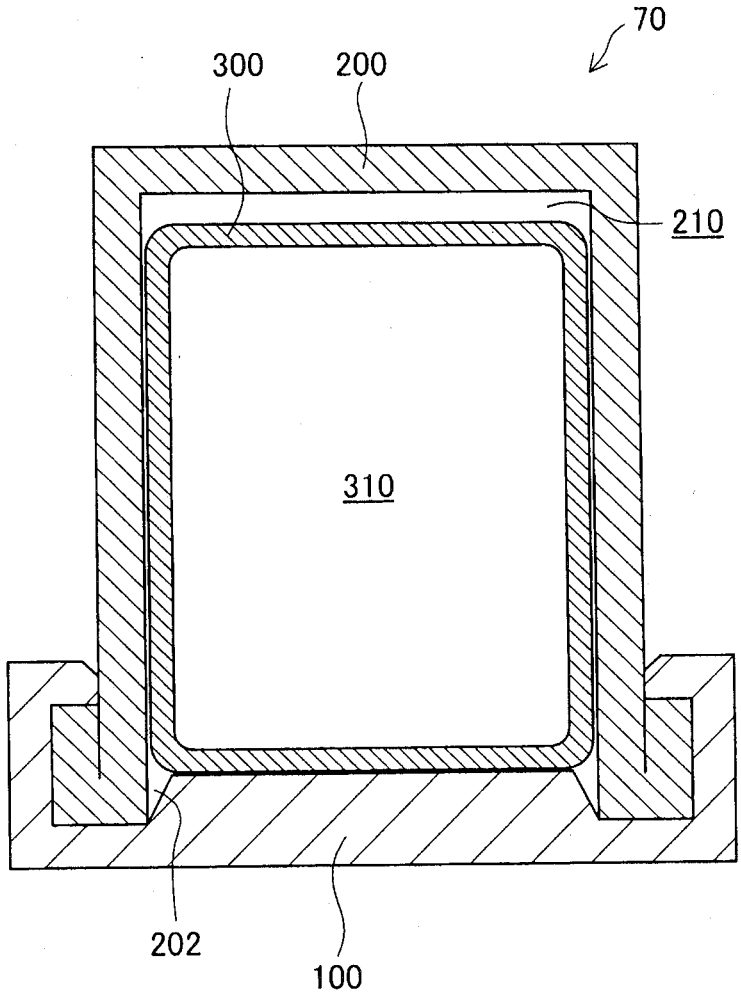
FIG. 4 is an explanatory diagram illustrating a basic configuration of the ink cartridge 70.

FIGS. 2 to 4 are explanatory diagrams illustrating a basic configuration of the ink cartridge 70. FIGS. 2 and 3 illustrate a schematic configuration of the external appearance of the ink cartridge 70. FIG. 4 illustrates a schematic configuration of a cross section of the ink cartridge 70. The ink cartridges 70 are provided with a flow path member 100, a containing box 200, and an ink containing bag 300 (refer to FIGS. 3 and 4). The ink containing bag 300 is arranged inside a space 210 which is surrounded by the flow path member 100 and the containing box 200 (refer to FIG. 4). Here, in FIG. 3, for convenience of understanding the configuration of the ink cartridge 70, a state where the containing box 200 is detached from the flow path member 100 is illustrated, but when the ink cartridge 70 is mounted in the printer 20 and used, the containing box 200 as shown in FIGS. 2 and 4 is fixed to the flow path member 100. In this state, the ink cartridge 70 is substantially a rectangular shape.

Figure 5:
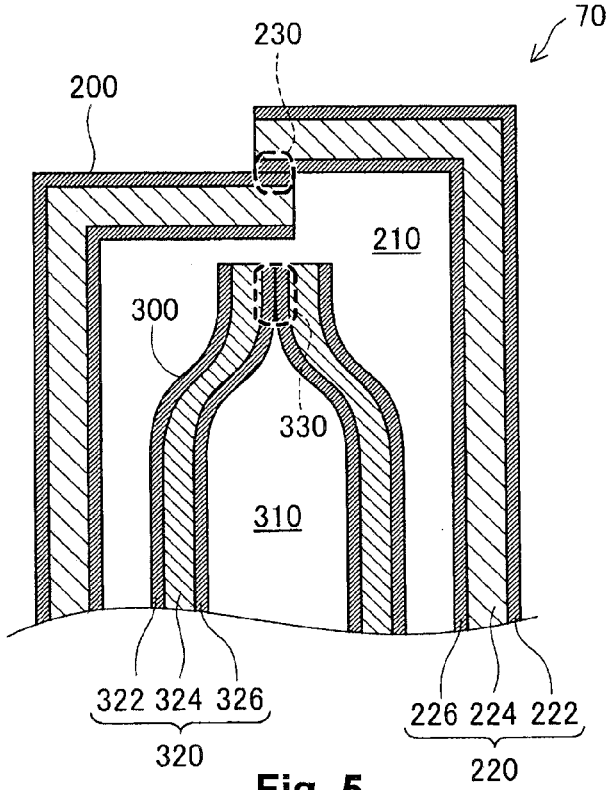
FIG. 5 is a partial cross sectional diagram illustrating a detailed configuration of an ink containing bag 300 and a containing box 200.

The ink containing bag 300 is a bag which is formed of a flexible material and which has an ink containing space 310 where it is possible for ink to be contained in an inner portion. As shown in FIG. 3, the ink containing bag 300 is a so-called gusset bag which has a gusset, but may be a so-called pillow type bag which does not have a gusset. FIG. 5 is a partial cross sectional diagram illustrating a detailed configuration of the ink containing bag 300 and the containing box 200. The ink containing bag 300 of the present working example is formed by a flexible sheet 320 with a three layer configuration in which polyethylene layers 322 and 326 are laminated on both sides of an aluminum deposition film 324 (see FIG. 5). Specifically, the ink containing bag 300 is manufactured by adhering the flexible sheets 320 at a bonding section 330 and forming a bag shape. The aluminum deposition film 324 has a so-called barrier property and suppresses the passage of liquid or gas through the flexible sheet 320. As a result, phenomena, which cause a decrease in the solvent amount in the ink which is contained inside the ink containing space 310 (increase in ink concentration) or deterioration of the ink by the inflow of air into the ink containing space 310, are suppressed.

Figure 6:
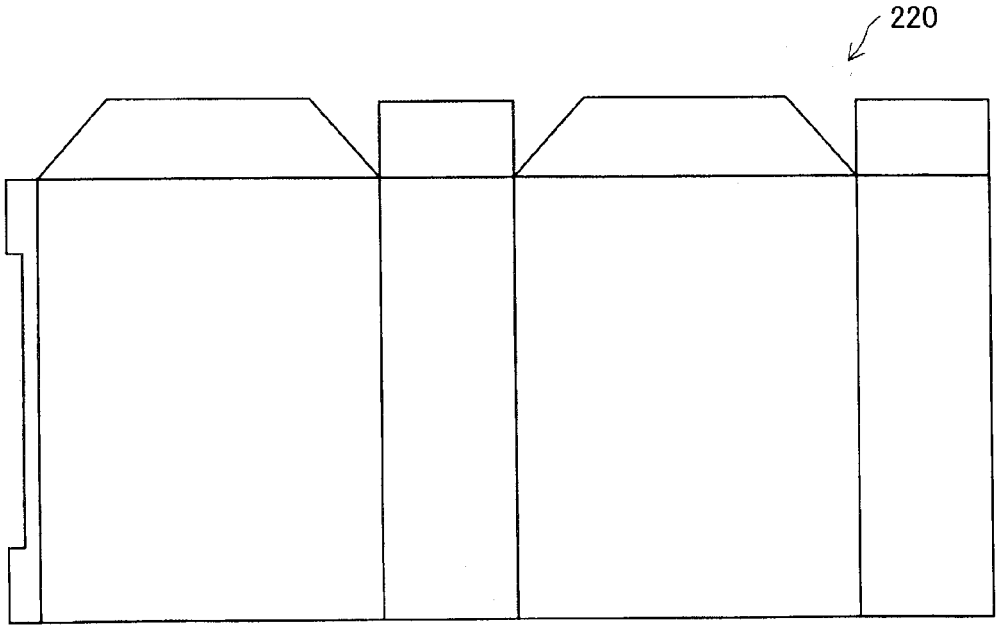
FIG. 6 is an explanatory diagram illustrating a configuration of a paper material 220.

The containing box 200 is substantially a rectangular shaped box which is formed by a paper material which is a plant derived material. However, one surface of the six surfaces which define the substantially rectangular shape of the containing box 200 is an opening 202 (refer to FIG. 3). As will be described later, the containing box 200 is fixed with regard to the flow path member 100 such that the opening 202 is blocked by the flow path member 100 (refer to FIG. 4). The containing box 200 of the present working example is formed by the paper material 220 with a three layer configuration in which polyethylene layers 222 and 226 are laminated on both sides of paper 224 (refer to FIG. 5). The containing box 200 is manufactured by bending one sheet of the paper material 220 shown in FIG. 6, adhering at a bonding section 230 (refer to FIG. 5), and assembling in a box shape. Since the containing box 200 has a constant rigidity in comparison with the ink containing bag 300, it is possible to protect the ink containing bag 300 which is formed by the flexible material during the product transportation of the ink cartridge 70 or during mounting and use in the ink cartridge 70. Here, since the containing box 200 surrounds the ink containing bag 300, it is also possible to be represented as surrounding the ink containing space 310 which is formed inside the ink containing bag 300. In the present specifications, "surrounding" a target object (or target space) using a certain object has the meaning that the object configures at least a portion of a surface which encloses the target object (or target space) without being limited to a case where the object completely encloses the target object (or target space).

Figure 7:
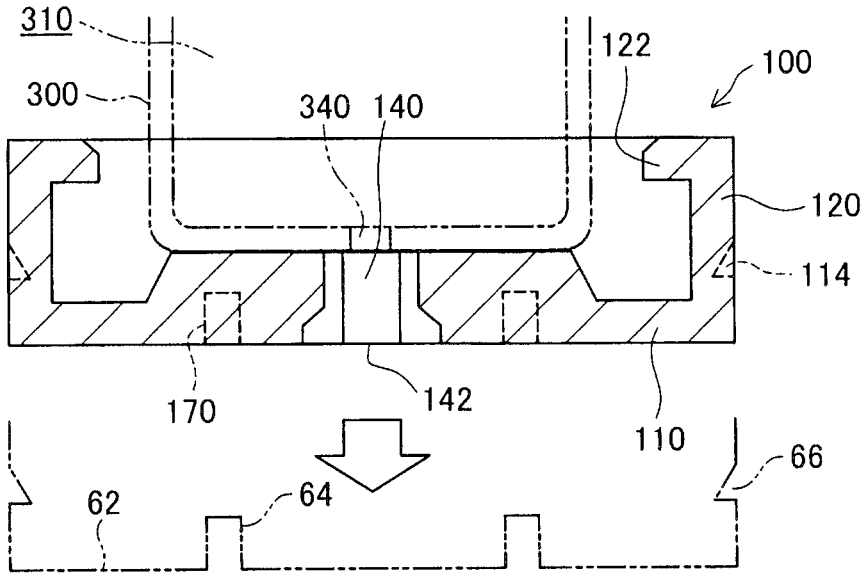
FIG. 7 is an explanatory diagram illustrating a detailed configuration of a flow path member 100.
Figure 8:
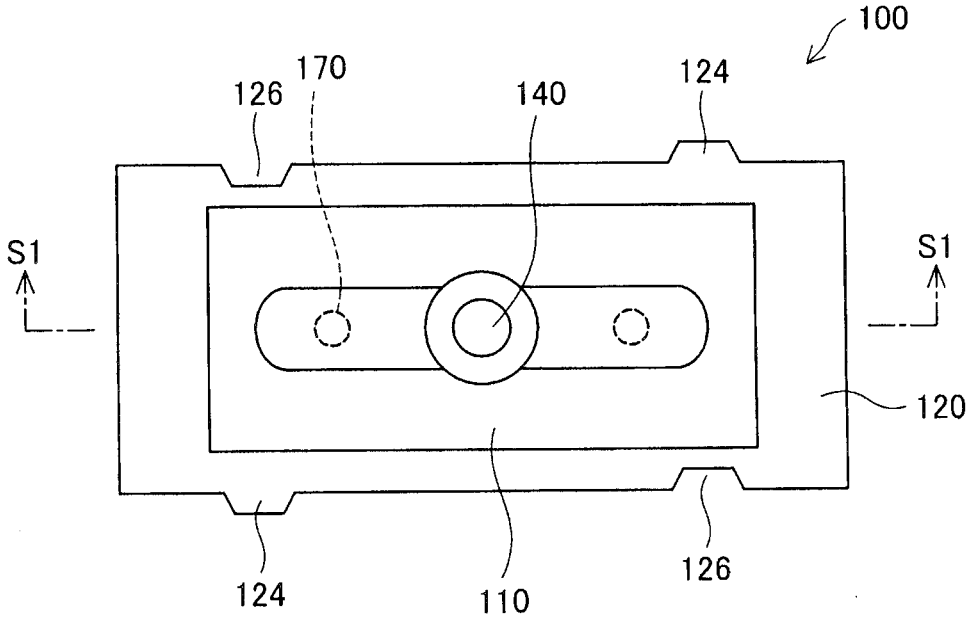
FIG. 8 is an explanatory diagram illustrating a detailed configuration of a flow path member 100.

FIGS. 7 and 8 are explanatory diagrams illustrating a detailed configuration of the flow path member 100. FIG. 8 illustrates a planar configuration of a side which opposes the containing box 200 of the flow path member 100, and FIG. 7 illustrates a cross sectional configuration of the flow path member 100 in S1-S1 position in FIG. 8. The flow path member 100 is formed using a resin material (for example, polypropylene) with higher rigidity than the paper material which is the material of the containing box 200. The flow path member 100 has a shape which has a base section 110 with a substantially flat shape and a protruding section 120 which is formed across the peripheral edge of the base section 110 and which protrudes toward the side (upper side in FIG. 7) which opposes the containing box 200. A flange section 122 which extends substantially parallel with the base section 110 toward the inner side (center side of the base section 110) is formed at the tip end of the protruding section 120.

A supply port 142, which supplies ink which is contained inside the ink containing space 310 of the ink containing bag 300 to the print head 61 of the printer 20, and a flow path 140, which links the ink containing space 310 and the supply port 142, are formed in the base section 110 of the flow path member 100. More specifically, the ink containing bag 300 is fixed to the flow path member 100 by, for example, adhesion. The ink containing space 310 and the flow path 140 of the flow path member 100 are linked via an opening 340 which is formed in the ink containing bag 300. Then, the ink which is contained in the ink containing space 310 is supplied to the print head 61 via the opening 340, the flow path 140, and the supply port 142. Here, a valve which is not shown is provided in the supply port 142 of the flow path member 100. In order to further reduce the environmental burden, a valve which does not use a metal material (for example, the clean click connector of Pack Plus Ltd., or the Duckbill valve of Vernay Laboratories, Inc.) may be used as the valve.

On the surface (surface of the lower side in FIG. 7) of the opposite side to the side which opposes the containing box 200 of the flow path member 100, two concave sections 170 are formed. When the ink cartridge 70 is mounted in the holder 62, the positional alignment of the ink cartridge 70 with regard to the holder 62 is realized by engaging each of the concave sections 170 of the flow path member 100 with each convex section 64 which is formed in the holder 62. Here, engagement sections (engagement section 114 of the flow path member 100 and engagement section 66 of the holder 62) which prevent the separation of the ink cartridge 70 from the holder 62 are formed in the flow path member 100 and the holder 62 by mutual engagement in a state where the ink cartridge 70 is mounted in the holder 62. Also, in the state with the ink cartridge 70 mounted in the holder 62, at least one specified surface of the ink cartridge 70 (of the surfaces constituted by the containing box 200, the surface facing opposite the flow path member 100) is exposed without being hidden by the holder 62 or the like.

Figure 9:
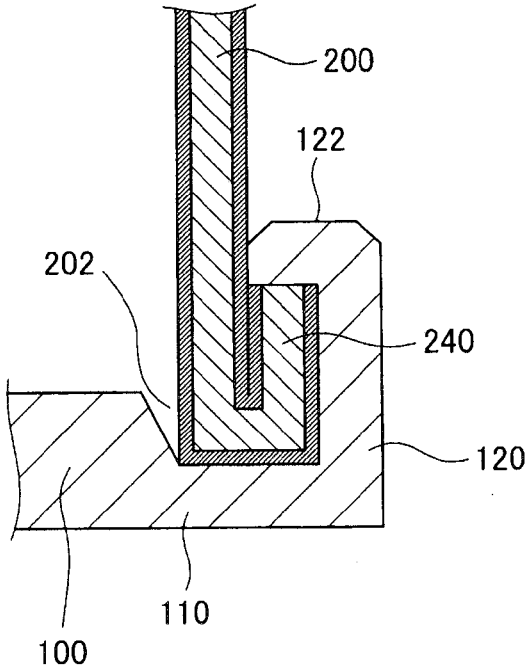
FIG. 9 is an explanatory diagram illustrating in detail a configuration for fixing the containing box 200 and the flow path member 100.

FIG. 9 is an explanatory diagram illustrating in detail a configuration for fixing the containing box 200 and the flow path member 100. The containing box 200 has a folded section 240 along a portion or the whole of the periphery of the opening 202. The folded section 240 is a section with a flap shape which is formed by folding an edge portion of the opening 202 side of the containing box 200 to the outside. That is, the folded section 240 extends in a direction so as to separate from the opening 202 from at least a portion of the edge portion of the opening 202. Accordingly, the thickness of the containing box 200 is greater in the portion in which the folded section 240 is formed than in other portions.

As shown in FIG. 9, the containing box 200 and the flow path member 100 are fixed by the engagement of the folded section 240 and the protruding section 120. More specifically, a gap between the surface of the base section 110 of the flow path member 100 and the surface of the flange section 122 of the protruding section 120 along the direction in which the containing box 200 separates from the flow path member 100 (upward direction in FIG. 9, referred to below as a "first direction") is slightly less than the length of the folded section 240. As a result, when the portion in which the folded section 240 of the containing box 200 is formed pushes into the protruding section 120 side of the flow path member 100, the protruding section 120 pinches the folded section 240 so as to be compressed along the first direction. Due to this, the containing box 200 is fixed to the flow path member 100. Here, in such a fixed state, the flange section 122 of the protruding section 120 prevents movement along the first direction where the containing box 200 separates from the flow path member 100 by the interference of the folded section 240. In this manner, the protruding section 120 which includes the flange section 122 of the flow path member 100 functions as a gripping portion which fixes the containing box 200 and the folded section 240 of the containing box 200 functions as a portion to be gripped which is gripped by the gripping portion.

Since the fixing method of the containing box 200 and the flow path member 100 is as described above, the engagement of the folded section 240 and the protruding section 120 is released by pulling the portion in which the folded section 240 of the containing box 200 is formed so as to separate from the protruding section 120 of the flow path member 100, and the containing box 200 is easily detached from the flow path member 100.

Figure 10:
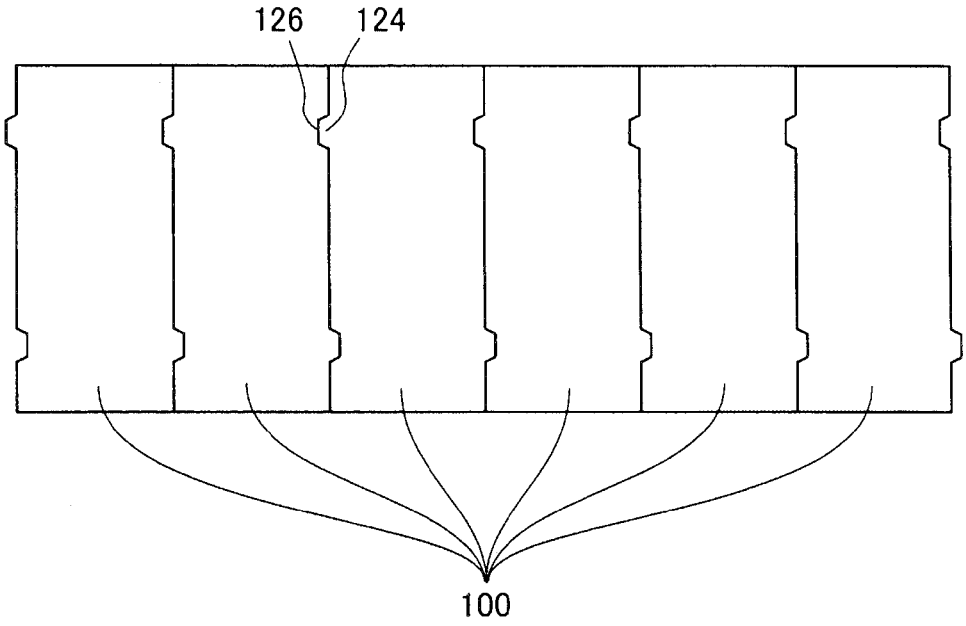
FIG. 10 is an explanatory diagram illustrating a state in which a plurality of the flow path members 100 are lined up.
Figure 11:
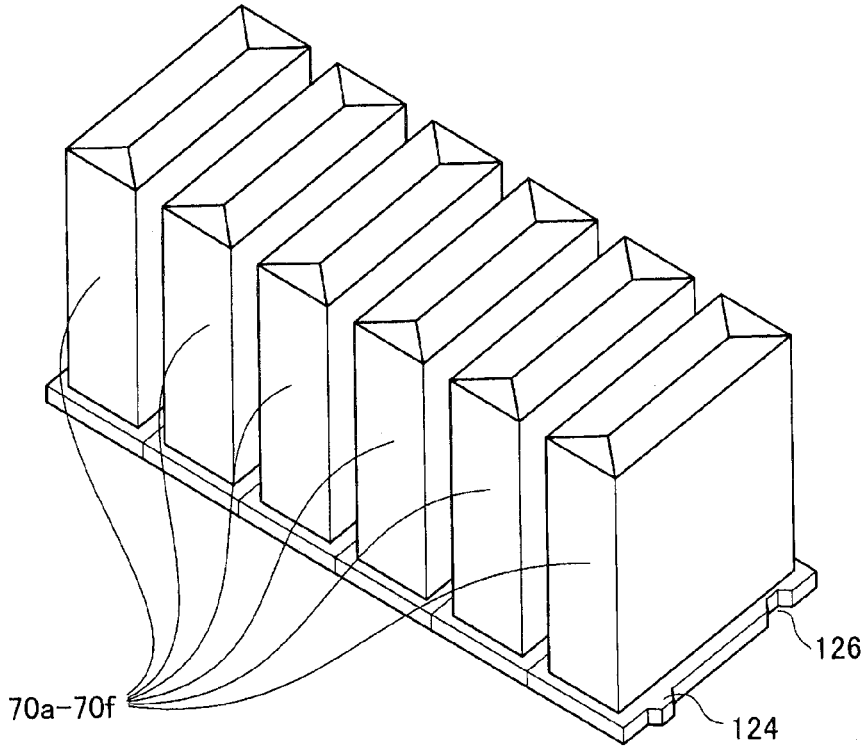
FIG. 11 is an explanatory diagram illustrating a state in which a plurality of the ink cartridges 70 are lined up.

As shown in FIG. 8, in the present working example, a concave section 126 is formed at one of one unit of edge surfaces (the upper side edge surface and the lower side edge surface in FIG. 8) which are parallel to each other and which are edge surfaces which are substantially orthogonal with the base section 110 of the flow path member 100, and a convex section 124 which engages with the concave section 126 is formed at the other of the one unit of edge surfaces. Here, in the present working example, the two units of the concave section 126 and the convex section 124 are formed on the one unit of edge surfaces. When a plurality of the flow path members 100 are lined up in this manner, as shown in FIG. 10, the concave section 126 of one flow path member 100 engages with the convex section 124 of another flow path member 100 which is adjacent, and the flow path members 100 are prevented from shifting by being integrated. As a result, as shown in FIG. 11, it is possible to integrate a plurality of the ink cartridges 70 while preventing position shifting relative to each other. Accordingly, for example, in a case where a plurality of the ink cartridges 70 are brought together and transported, it is possible to simplify the packaging.

As described above, in the ink cartridge 70 of the present working example, by surrounding the ink containing bag 300, the containing box 200 which surrounds the ink containing space 310 is formed using paper which is a plant derived material. Therefore, in the ink cartridge 70 of the present working example, it is possible to reduce the environmental burden in the life cycle. In particular, in the ink cartridge 70 of the present working example, by configuring only one surface among the six surfaces which define the substantially rectangular shape of the ink cartridge 70 using the flow path member 100 and configuring the remaining five surfaces using the containing box 200, it is possible to suppress the use of resin material to the minimum and to greatly reduce the environmental burden.

In addition, in the ink cartridge 70 of the present working example, the flow path member 100, which has the supply port 142 which supplies ink which is contained in the ink containing space 310 to the print head 61 and the flow path 140 which links the ink containing space 310 and the supply port 142, is formed using a resin material. In addition, the containing box 200 has the opening 202, and the containing box 200 is fixed with regard to the flow path member 100 such that the opening 202 is blocked by the flow path member 100. As a result, in the ink cartridge 70 of the present working example, it is possible to suppress the generation of defects such as ink leaks by forming the supply port and the flow path for the supply of ink in the flow path member 100 which has comparatively high rigidity. In addition, in the ink cartridge 70 of the present working example, it is possible to stably fix the ink cartridge 70 to the holder 62 of the printer 20 via the flow path member 100 which has comparatively high rigidity. Furthermore, it is possible to stably fix the containing box 200 using the flow path member 100 which has comparatively high rigidity. Accordingly, in the ink cartridge 70 of the present working example, it is possible to suppress the generation of defects such as warping or deforming of the ink cartridge 70 when mounting in the holder 62 or when detaching from the holder 62.

In addition, in the ink cartridge 70 of the present working example, since it is possible to easily detach the containing box 200 from the flow path member 100, it is possible to promote the recycling of the containing box 200. In addition, even assuming a case of disposing of the ink cartridge 70, it is possible to carry out the disposal in a state where the plant derived material and the other materials are separated.

In addition, in the ink cartridge 70 of the present working example, it is possible to suppress the generation of ink leaks since the ink is contained in the ink containing space 310 in the inner portion of the ink containing bag 300 which is formed using flexible material. In particular, in the present working example, since the ink containing bag 300 is formed using a material which has a barrier property, phenomena, which cause a decrease in the solvent amount in the ink which is contained inside the ink containing space 310 (increase in ink concentration) or deterioration of the ink by the inflow of air into the ink containing space 310, are suppressed.

In addition, in the ink cartridge 70 of the present working example, the containing box 200 has the folded section 240, and the thickness of the containing box 200 is greater in the portion where the folded section 240 is formed than in the other portions. As a result, it is possible to form a portion which has a large thickness using simple processing with regard to the paper material 220 which is the material of the containing box 200. In addition, by the protruding section 120 of the flow path member 100 which has comparatively high rigidity pinching so as to compress the folded section 240 along the first direction, the containing box 200 is fixed to the flow path member 100. As a result, it is possible to stably fix the containing box 200 to the flow path member 100. In addition, since the folded section 240 of the containing box 200 which functions as the portion to be gripped is provided to be adjacent to the opening 202, it is possible to suppress the size of the protruding section 120 of the flow path member 100 as the gripping portion to the minimum and it is possible to suppress the environmental burden.

In addition, in the ink cartridge 70 of the present working example, due to the forming of the concave section 170 for positionally aligning the ink cartridge 70 with regard to the holder 62 by engaging the convex sections 64 which are formed in the holder 62 with the flow path member 100 which has comparatively high rigidity, it is possible to improve the position alignment precision. In particular, in the ink cartridge 70 of the present working example, since the concave section 170 for positional alignment is formed in a portion where the supply port 142 is provided in the flow path member 100, it is possible to improve the positional alignment precision in the vicinity of the supply port 142, and it is possible to effectively suppress the generation of defects such as ink leaks.

A-3. FIRST WORKING EXAMPLE MODIFIED EXAMPLE

Figure 12:
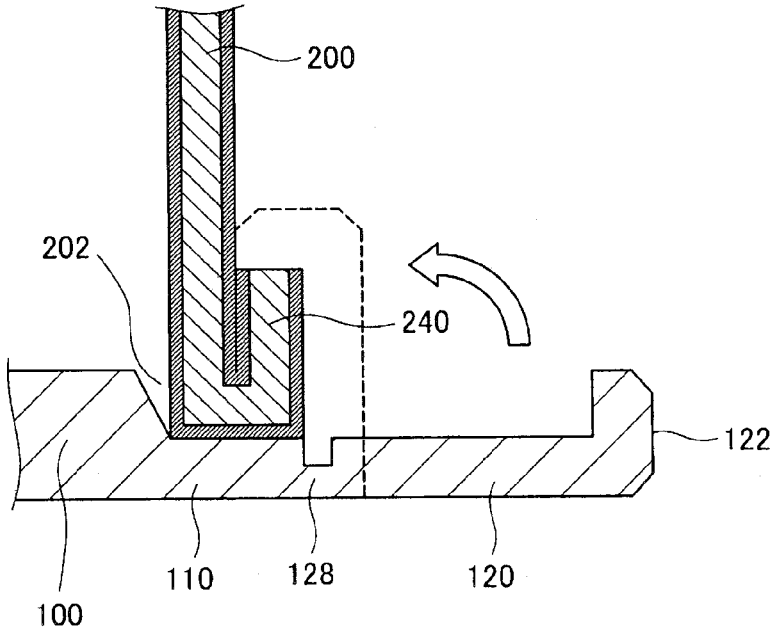
FIG. 12 is an explanatory diagram illustrating a modified example of a configuration for fixing the containing box 200 and the flow path member 100.

FIG. 12 is an explanatory diagram illustrating a modified example of a configuration for fixing the containing box 200 and the flow path member 100. The modified example shown in FIG. 12 differs from the first working example shown in FIG. 9 in that the protruding section 120 is movable. Specifically, with the modified example shown in FIG. 12, in the state before the containing box 200 is fixed, the protruding section 120 of the flow path member 100 is in a state substantially parallel with the base section 110, and at the boundary position of the protruding section 120 and the base section 110, for example, a hinge part 128 for which the thickness is made thinner and the rigidity is reduced is formed. By arranging the containing box 200 at the position at which it is to be fixed, and bending the protruding section 120 at substantially a 90 degree angle with the hinge part 128 as a fulcrum, a state is formed in which the protruding section 120 is gripped so as to compress the folded section 240 of the containing box 200, and by doing this, the containing box 200 is fixed to the flow path member 100. Also, by applying pressure to the protruding section 120 and returning it to its initial position, the containing box 200 is detached from the flow path member 100. With the modified example shown in FIG. 12, it is easier to perform fixing and detaching of the containing box 200 on the flow path member 100.

Figure 13:
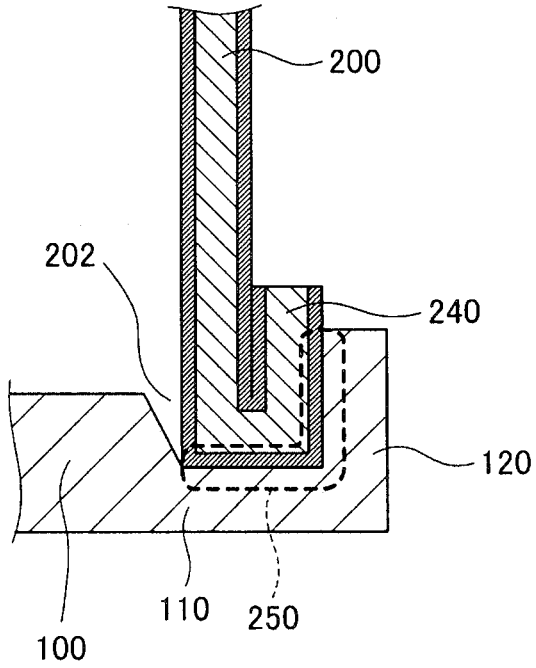
FIG. 13 is an explanatory diagram illustrating another modified example of a configuration for fixing the containing box 200 and the flow path member 100.

FIG. 13 is an explanatory diagram illustrating another modified example of a configuration for fixing the containing box 200 and the flow path member 100. The modified example shown in FIG. 13 fixes the containing box 200 to the flow path member 100 not by the protruding section 120 gripping the folded section 240 of the containing box 200, but rather by adhering a part of the containing box 200 that contacts the flow path member 100 (bonding section 250) to the flow path member. With the modified example shown in FIG. 13, it is possible to increase the sealing properties between the containing box 200 and the flow path member 100, making it possible to suppress the occurrence of ink leaks, for example. It is also possible to reduce the size (volume) of the flow path member 100 formed using the resin material, making it possible to further reduce the environmental burden.

Figure 14A:
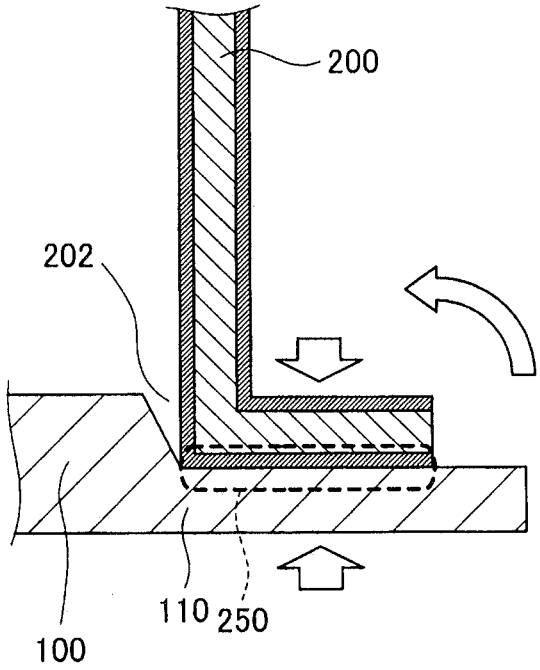
FIGS. 14A and 14B are explanatory diagrams illustrating another modified example of a configuration for fixing the containing box 200 and the flow path member 100.
Figure 14B:
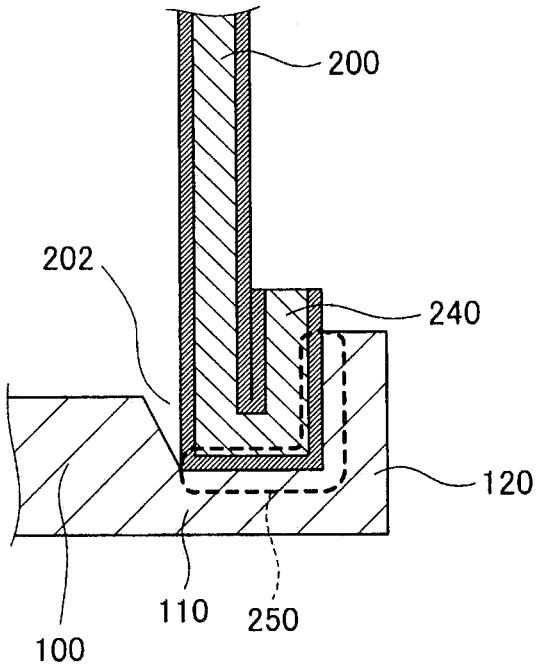

FIGS. 14A and 14B are explanatory diagrams illustrating another modified example of a configuration for fixing the containing box 200 and the flow path member 100. With the modified example shown in FIGS. 14A and 14B, fixing of the containing box 200 and the flow path member 100 is performed using the following steps. First, as shown in FIG. 14 A, the bonding section 250 of the containing box 200 and the flow path member 100 are extended in a direction parallel to the base section 110 and overlapped, and the bonding section 250 of the containing box 200 and the flow path member 100 are thermally adhered by crimping while heating so as to pinch the bonding section 250. Next, as shown in FIG. 14 B, the base section 110 of the flow path member is deformed while heating so as to bend at substantially a 90 degree angle, forming the folded section 240 on the containing box 200. With this modified example, adhesion is done by heating and crimping so as to have the bonding section 250 of the containing box 200 and the flow path member 100 pinch the bonding section 250, so it is possible to obtain a high adhesion bonding strength.

B. SECOND WORKING EXAMPLE

Figure 15:
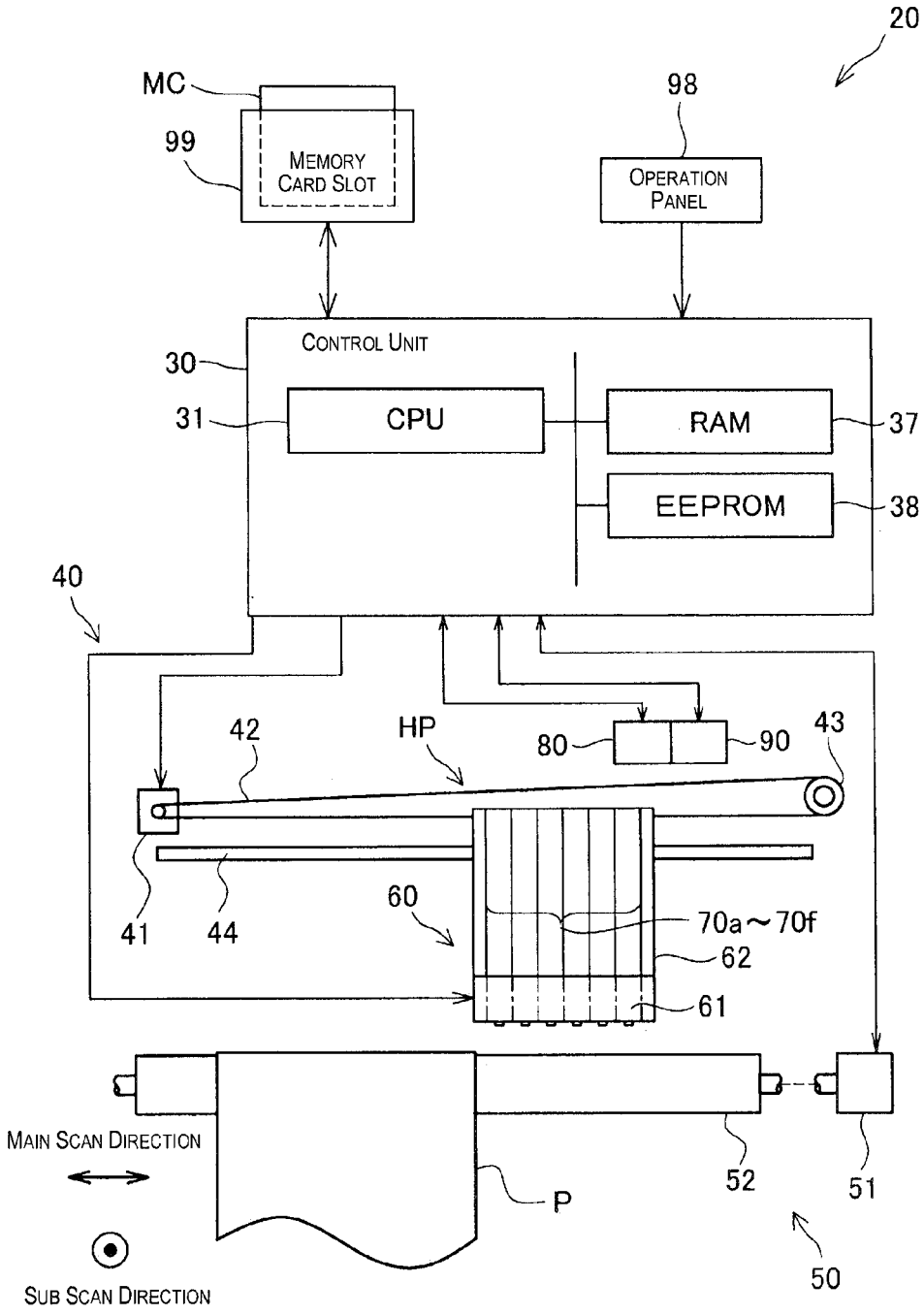
FIG. 15 is an explanatory diagram illustrating a schematic configuration of the printer 20 of the second working example.

B-1. Printer Configuration:

FIG. 15 is an explanatory diagram illustrating a schematic configuration of the printer 20 of the second working example. The printer 20 of the second working example differs from the printer 20 of the first working example shown in FIG. 1 mainly in that it is equipped with a reading unit 80 and a writing unit 90, and also in that the ink cartridge 70 has a label 180 on which information relating to the ink cartridge 70 is recorded (a detailed description is given later).

The reading unit 80 reads information recorded on the label 180 of the ink cartridge 70, and the writing unit 90 writes (records) information to the label 180 of the ink cartridge 70. With this working example, the reading unit 80 and the writing unit 90 are installed in a fixed manner above the print head unit 70 along the gravitational direction.

The arrangement of the reading unit 80 and the writing unit 90 along the main scan direction is an arrangement such that the area in which the paper P is conveyed, the home position HP of the print head unit 60 (the position in FIG. 15), and the reading unit 80 and the writing unit 90 are aligned in sequence. Specifically, the reading unit 80 and the writing unit 90 are arranged at the opposite side to the area in which the paper P is conveyed seen from the home position HP. However, the position of the reading unit 80 and the writing unit 90 can be changed to any position.

Figure 16:
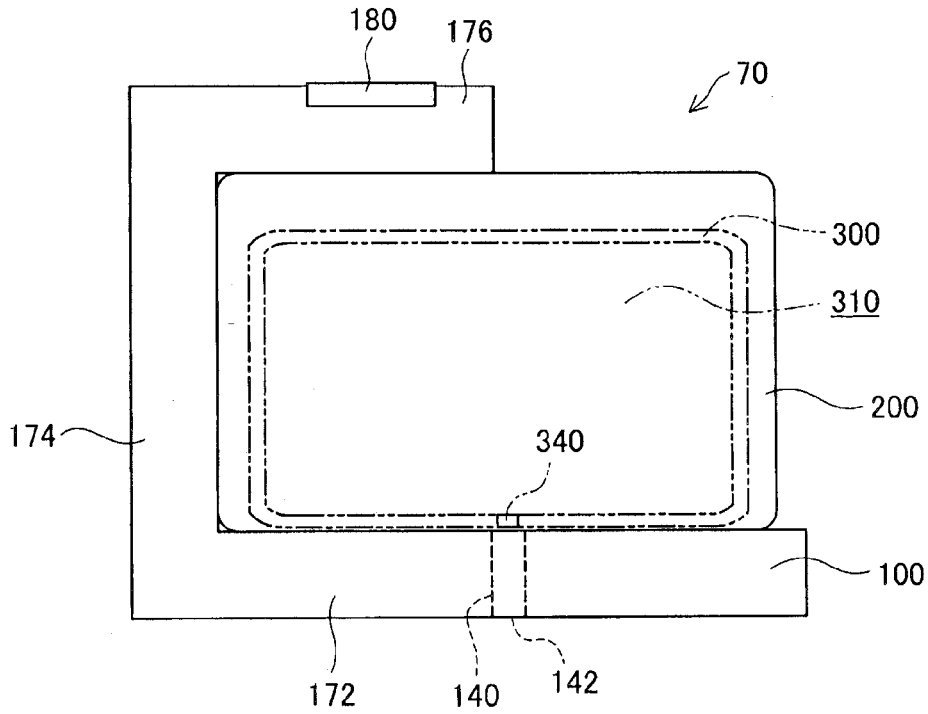
FIG. 16 is an explanatory diagram illustrating a schematic configuration of the ink cartridge 70 of the second working example.

B-2. Ink Cartridge Configuration:

FIG. 16 is an explanatory diagram illustrating the schematic configuration of the ink cartridge 70 of the second working example. The same as with the first working example, with the second working example, the ink cartridge 70 has a substantially rectangular solid shape, and is constituted from the flow path member 100, the containing box 200, and the ink containing bag 300. The containing box 200 is fixed to the flow path member 100, and the ink containing bag 300 is arranged within the space enclosed by the flow path member 100 and the containing box 200. The ink containing bag 300 is fixed to the flow path member 100, the ink containing space 310 and the flow path 140 of the flow path member 100 are linked via the opening 340 formed on the ink containing bag 300, and the ink contained in the ink containing space 310 is supplied to the print head 61 via the opening 340, the flow path 140, and the supply port 142.

With the ink cartridge 70 of the second working example, the shape of the flow path member 100 differs from that of the ink cartridge 70 of the first working example. Specifically, with the ink cartridge 70 of the second working example, the flow path member 100 has a shape following the three contiguous surfaces of the containing box 200. In more specific terms, the flow path member 100 has a shape for which the following are contiguous (specifically, substantially a "J" shape): a first section 172 formed along a first surface of the containing box 200 (bottom surface in FIG. 16) (the part having the flow path 140 and the supply port 142), a second section 176 formed along a portion of a second surface (top surface in FIG. 16) facing opposite the first surface of the containing box 200, and a third section 174 formed along a third surface that connects the first surface and the second surface of the containing box 200 (the surface substantially orthogonal to the first surface and the second surface, the left surface in FIG. 16). In this way, with the ink cartridge 70 of the second working example, of the six surfaces defining the substantially solid rectangle shape, the entire second surface and a portion of the first surface are formed by the flow path member 100, and the remaining surfaces are formed by the containing box 200.

The same as with the first working example, at least a portion of the surface facing opposite the flow path member 100 with the containing box 200 can be an opening. In this case, the opening is blocked by the flow path member 100. Also, though not shown in FIG. 16, the concave sections 170 (FIG. 7) for alignment with the holder 62 are formed on the first section 172. Because of that, it is possible to improve the alignment precision near the supply port 142 with the flow path member 100, making it possible to effectively suppress the occurrence of problems such as ink leaks and the like. However, it is also possible for the concave sections 170 to be formed on the second section 176. In this case, it is possible to improve the alignment precision near the label 180 for the flow path member 100, and possible to improve the relative positional relationship precision of the label 180 and the reading unit 80 and writing unit 90, and as a result, it is possible to achieve an improvement in the reading and writing precision of the label 180.

The label 180 is pasted using an adhesive agent, for example, on the outside surface of the second section 176 of the flow path member 100 (the surface on the opposite side to the surface facing opposite the containing box 200). The label 180 functions as the information recording unit on which information relating to the ink cartridge 70 is recorded. As the information recorded on the label 180, examples include the ink cartridge 70 manufacturing lot number, information indicating the type of ink contained (color classification or ink product number), information relating to the ink usage restrictions (e.g. the ink manufacturing date), information expressing that this is an official product corresponding to the printer 20, information relating to the ink residual volume and the like. With this working example, the flow path member 100 which is the member on which the label 180 is provided correlates to the high rigidity member of the invention. However, the second section 176 which is the part on which the label 180 is provided with the flow path member 100 can also be interpreted as correlating to the high rigidity member of the invention.

The reading or writing of the label 180 by the reading unit 80 or the writing unit 90 is executed when the print head unit 60 (FIG. 15) is moved, and the label 180 provided on the ink cartridge 70 is passed through the reading unit 80 or the writing unit 90. In a state with the ink cartridge 70 mounted in the holder 62, at least one specified surface of the ink cartridge 70 (the surface facing opposite the part on which the flow path 140 is formed with the flow path member 100) is exposed without being hidden by the holder 62 or the like, so the label 180 is also exposed. By doing this, the user is able to check the status of the label 180 (for example the presence or absence of dirt or peeling) even in a state with the ink cartridge 70 mounted in the holder 62.

Figure 17:
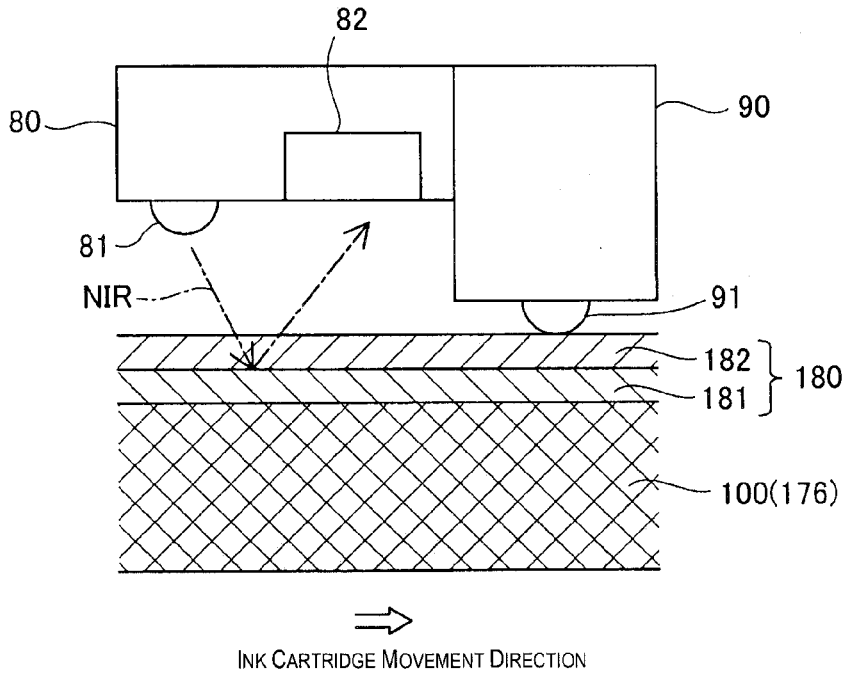
FIG. 17 is an explanatory diagram illustrating the relationship between the label 180 and the reading unit 80 and writing unit 90.

FIG. 17 is an explanatory diagram illustrating the relationship between the label 180 and the reading unit 80 and writing unit 90. The label 180 has a two layer configuration including a recording layer 181 formed on the second section 176 of the flow path member 100 and a masking layer 182 formed on the recording layer 181. The label 180 is not limited to having a two layer configuration, but can also have a three layer configuration equipped with, for example, an adhesive layer for adhering the label 180 between the flow path member 100 and the recording layer 181, and can also have a single layer configuration of only the recording layer 111.

The recording layer 181 is a layer for recording information relating to the ink cartridge 70 using a pattern. This pattern is a pattern expressed according to preset rules, and can be read mechanically based on those rules. As such a pattern, for example, it is possible to use a one-dimensional code or a two-dimensional code. The recording layer 181 has the property of the color changing irreversibly (said another way, the property of the light absorption rate changing) by receiving heat of a temperature of a designated level or higher, and a pattern is configured that expresses information with areas which have not been heated, and areas which have been heated and changed color. The recording layer 181 having this kind of property can be formed using a well known heat sensitive color former. With this working example, the information recorded in the recording layer 181 can be put into an unreadable state (invalid state) by changing the color of the entire area by heating the entire area of the recording layer 181. The recording layer 181 does not require a recording medium that uses an electrical method, for example semiconductor memory, so it is possible to simplify the configuration of the ink cartridge 70, and furthermore, it is possible to suppress the environmental burden because metal materials are not required.

The masking layer 182 is a layer for concealing the identification information recorded in the recording layer 181 by making it visually unrecognizable. In specific terms, the masking layer 182 has the property of absorbing the light rays of at least a portion of the wavelength area of the visible light rays, and allowing infrared light rays to pass through. With this working example, the masking layer 182 is visible to the human eye as black, regardless of the pattern expressed on the recording layer 181. Various publicly known printing materials can be used as the printing material having the properties of the masking layer 182.

The reading unit 80 is equipped with an irradiation unit 81 and a light receiving unit 82, and reads the information recorded on the label 180 using an optical method. The irradiation unit 81 and the light receiving unit 82 are provided on the surface facing opposite the ink cartridge 70 of the reading unit 80. The irradiation unit 81 has an infrared ray LED built in, and irradiates near infrared rays NIR. The near infrared rays NIR irradiated from the irradiation unit 181 pass through the masking layer 182 of the label 180, and a volume of the near infrared rays NIR according to the reflectance of the recording layer 181 is reflected by the recording layer 181. The light receiving unit 82 is equipped with a light receiving element called a CCD (Charge Coupled Device). The reading unit 80 receives light at the light receiving unit 82, encodes the converted electrical signals using a built in circuit (not illustrated), and outputs those to the control unit 30. The control unit 30 converts the input signals to information. In this way, information recorded on the label 180 is read.

The writing unit 90 is equipped with a heat generating part 91. The heat generating part 91 is equipped with electrodes and heat elements, and by making them conductive to the electrodes, the heating elements emit heat. By emitting heat in a state in contact with a heat sensitive medium (with this working example, the label 180), the heat generating part 91 changes the color of the contact location of the heat sensitive medium. As this writing unit 90, it is possible to use a thermal head used with thermal printers and thermal transfer printers. The writing unit 90 heats the label 180 using the heat generating part 91, and writes information to the label 180 or makes a state for which the information recorded on the label 180 is invalid.

As described above, with the ink cartridge 70 of the second working example, the same as with the first example, the containing box 200 which encloses the ink containing space 310 by enclosing the ink containing bag 300 is formed using a plant derived material, so it is possible to reduce the environmental burden over the life cycle.

Also, with the ink cartridge 70 of the second working example, the label 180 is provided on the flow path member 100 which is formed using a material of a higher rigidity than that of the material of the containing box 200, so skewing of the relative positional relationship between the reading unit 80 or writing unit 90 the printer 20 is equipped with and the label 180 is suppressed, and it is possible to achieve an improvement in precision when reading the label 180 using the reading unit 80 or when writing to the label 180 using the writing unit 90 (the occurrence of misreading and miswriting are suppressed). In particular, with this working example, because writing of information is performed in a state with the writing unit 90 in contact with the label 180, there is the risk of miswriting when the label 180 is provided on a member with relatively low rigidity, but since the label 180 is provided on the flow path member 100, it is possible to suppress the occurrence of that kind of miswriting.

Also, with the ink cartridge 70 of the second working example, the supply port 142 and the flow path 140 for ink supply are formed on the flow path member 100 with relatively high rigidity, so it is possible to suppress the occurrence of problems such as ink leaks or the like, and it is possible to stably fix the ink cartridge 70 to the holder 62 of the printer 20 via the flow path member 100 with relatively high rigidity, and furthermore, it is possible to achieve an improvement in the reading and writing precision of the label 180 using that kind of flow path member 100.

Also, with the ink cartridge 70 of the second working example, the flow path members 100 which are label 180 attachment members are arranged across a plurality of surfaces defining a substantially solid rectangular shape of the ink cartridge 70, so it is possible to increase the degree of freedom of arrangement of the supply port 142, the flow path 140, and the label 180, and thus, it is possible to increase the degree of freedom of arrangement of the holder 62, the reading unit 80, and the writing unit 90 of the printer 20.

Also, with the ink cartridge 70 of the second working example, among the plurality of surfaces that define the substantially solid rectangle shape of the ink cartridge 70, the label 180 is provided on the surface (top surface in FIG. 16) facing opposite the surface on which the supply port 142 is formed (bottom surface in FIG. 16), so even if ink leaks from the supply port 142, it is possible to suppress damage or soiling of the label 180 by ink.

B-3. SECOND WORKING EXAMPLE MODIFIED EXAMPLE

Figure 18:
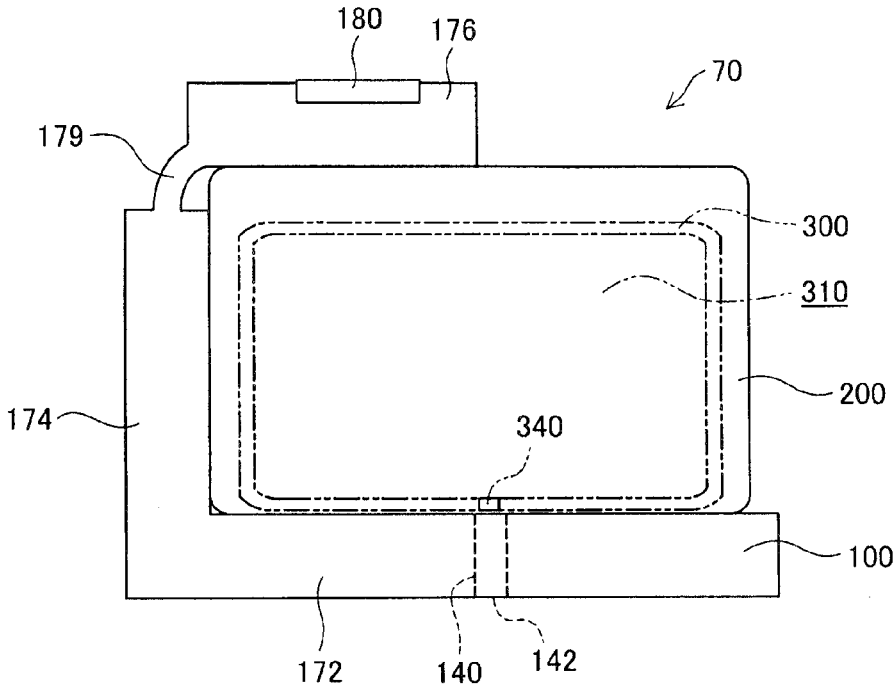
FIG. 18 is an explanatory diagram illustrating a modified example of the ink cartridge 70 of the second working example.

FIG. 18 is an explanatory diagram illustrating a modified example of the ink cartridge 70 of the second working example. The modified example shown in FIG. 18 differs from the second working example shown in FIG. 16 in that the linking part 179 of the third section 174 and the second section 176 of the flow path member 100 is thinner than the third section 174 and the second section 176. With the modified example shown in FIG. 18, before fixing the containing box 200 and the flow path member 100, the second section 176 is arranged in the upward axial direction of the third section 174. In this state, the label 180 is bonded to the second section 176. After that, when fixing the containing box 200, the second section 176 is bent at approximately a 90 degree angle with the linking part 179 as the fulcrum and contacts the containing box 200. With the modified example shown in FIG. 18, it is possible to more easily perform fixing and detaching of the containing box 200 on the flow path member 100, and it is also possible to easily perform forming of the label 180 on the flow path member 100.

Figure 19:
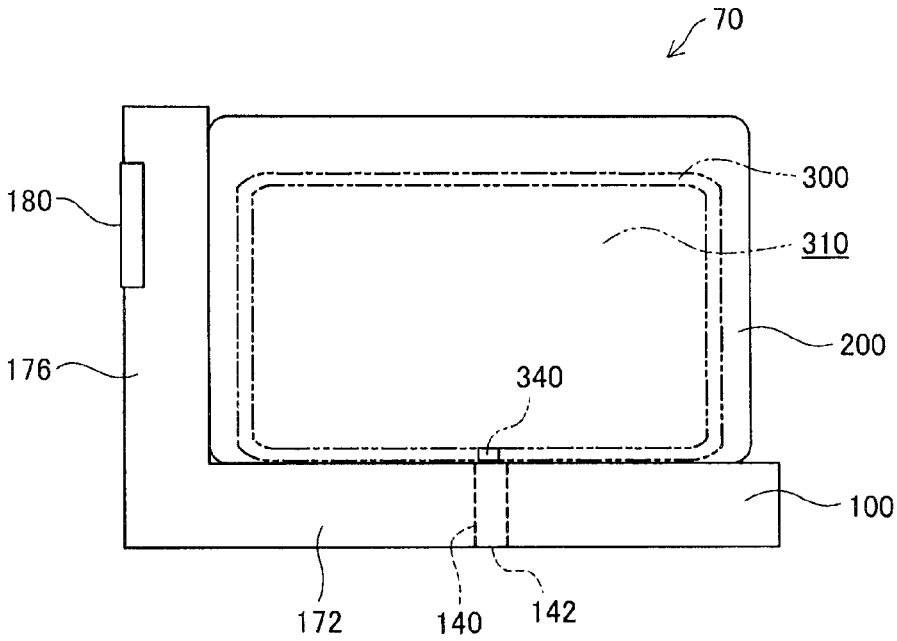
FIG. 19 is an explanatory diagram illustrating another modified example of the ink cartridge 70 of the second working example.

FIG. 19 is an explanatory diagram illustrating another modified example of the ink cartridge 70 of the second working example. With the modified example shown in FIG. 19, the flow path member 100 has a shape for which the flow path member follows two surfaces rather than three surfaces that are contiguous of the containing box 200. In more specific terms, the flow path member 100 has a shape for which the first section 172 formed along the first surface of the containing box 200 (bottom surface in FIG. 19) is connected to the second section 176 formed along the third surface which is orthogonal to and contiguous with the first surface of the containing box 200 (left surface in FIG. 19) (specifically, substantially an L shape). In this way, with the ink cartridge 70 of the modified example shown in FIG. 19, of the six surfaces defining the substantially solid rectangle shape, the entire surface of two surfaces are formed by the flow path member 100, and the remaining surfaces are formed by the containing box 200. The same as with the second working example, the label 180 is provided on the second section 176. With the modified example shown in FIG. 19, it is possible to reduce the size (volume) of the flow path member 100 and to further reduce the environmental burden while achieving an improvement in the reading and writing precision of the label 180. In particular, with the modified example shown in FIG. 19, since the first section 172 and the second section 176 are formed substantially orthogonally and contiguously, positional displacement of the second section 176 is well suppressed, and it is possible to greatly increase the reading and writing precision of the label 180.

With the modified example shown in FIG. 19 as well, the concave sections 170 (FIG. 7) for alignment with the holder 62 are formed on the first section 172. Because of that, it is possible to improve the precision of the alignment near the supply port 142 with the flow path member 100, and it is possible to effectively suppress the occurrence of problems such as ink leaks and the like. However, it is also possible for the concave sections 170 to be formed on the second section 176. In this case, it is possible to improve the precision of alignment near the label 180 for the flow path member 100, and possible to improve the precision of the relative positional relationship of the label 180, the reading unit 80, and the writing unit 90, and as a result, it is possible to achieve an improvement in the reading and writing precision of the label 180.

Figure 20:
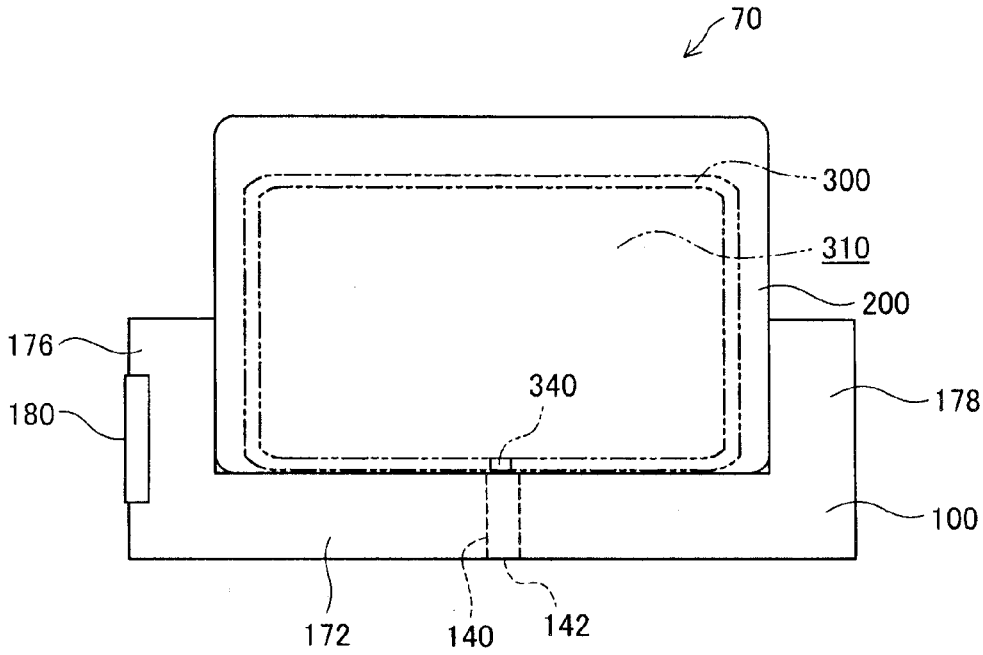
FIG. 20 is an explanatory diagram illustrating another modified example of the ink cartridge 70 of the second working example.

FIG. 20 is an explanatory diagram illustrating another modified example of the ink cartridge 70 of the second working example. With the modified example shown in FIG. 20, the flow path member 100 has a shape for which the first section 172 formed along the first surface of the containing box 200 (bottom surface in FIG. 20), the second section 176 formed along a portion of the third surface (left surface in FIG. 20) orthogonal to and contiguous with the first surface of the containing box 200, and a fourth section 178 formed along a portion of the fourth surface (right surface in FIG. 20) of the opposite side which is orthogonal to and contiguous with the first surface of the containing box 200 are contiguous (specifically, substantially a U shape). In this way, with the ink cartridge 70 of the modified example shown in FIG. 20, of the six surface defining the substantially solid rectangle shape, the entirety of one surface and a respective portion of two surfaces are formed by the flow path member 100, and the remaining surfaces are formed by the containing box 200. The same as with the second working example, the label 180 is provided on the second section 176. With the modified example shown in FIG. 20, it is possible to reduce the size (volume) of the flow path member 100 and to further reduce the environmental burden while achieving an improvement in the reading and writing precision of the label 180.

With the modified example shown in FIG. 20 as well, the concave sections 170 (FIG. 7) for alignment with the holder 52 are formed on the first section 172. Because of that, it is possible to improve the precision of alignment near the supply port 142 with the flow path member 100, and it is possible to effectively suppress the occurrence of problems such as ink leaks and the like. However, it is also possible to form the concave sections 170 on the second section 176. In this case, it is possible to improve the precision of alignment near the label 180 with the flow path member 100, and possible to improve the precision of the relative positional relationship of the label 180 and the reading unit 80 and writing unit 90, and as a result, it is possible to achieve an improvement in the reading and writing precision of the label 180.

C. OTHER MODIFIED EXAMPLES

Note that the invention is not limited to the working examples and embodiments noted above, and it is possible to realize it in many modes within a scope that does not stray from the gist, for example it can be realized as the following kinds of modified examples.

C1. Modified Example 1

The configuration of the printer 20 in the working example described above is only an example and various modifications are possible. For example, in the working example described above, the printer 20 is a so-called on-carriage type printer in which the ink cartridge 70 moves back and forth in the main scanning direction along with the print head unit 60, but it is possible for the invention to also be applied to a so-called off-carriage type printer in which a holder in which the ink cartridge 70 is mounted is provided at a separate location to the print head unit 60 and ink is supplied to the print head 61 from the ink cartridge 70 via a flexible tube or the like. In addition, in the working example described above, the printer 20 is a so-called serial type printer which performs printing while repeating an operation (main scanning) in which the print head unit 60 is moved back and forth in the main scanning direction and an operation (sub-scanning) in which the paper is transported in a transport direction which intersects with the main scanning direction, but it is possible for the invention to also be applied to a so-called impact printer in which printing is performed on single sheets of paper or a so-called line head type printer in which printing is performed while transporting paper in a direction which intersects the paper width direction under nozzle rows which are lined up and installed in the lower surface of the print head across the paper width length.

In addition, it is possible for the invention to also be applied to a liquid container which is mounted in a liquid consuming apparatus other than an ink jet printer as long as it is a liquid container which is mounted in an apparatus which consumes a liquid (which includes liquid bodies in which particles of functional materials are dispersed or flowing bodies such as gels). Examples of such a liquid consuming apparatus include a textile printing apparatus for adhering a pattern to a fabric, an apparatus which ejects a liquid which includes a material such as an electrode material or a coloring material which is used for manufacturing a liquid crystal display, an EL (electro luminescence) display, a surface-emitting display, a color filter or the like in a dispersed or dissolved form, an apparatus which ejects biological organic matter which is used in biochip manufacturing, an apparatus which is used as a precision pipette and which ejects a liquid which is a sample, an apparatus which ejects lubricant in a pinpoint manner in precision machines such as watches and cameras, an apparatus which ejects a transparent resin liquid such as an ultraviolet curing resin for forming a micro hemispherical lens (optical lens) which is used in optical communication elements or the like on a substrate, an apparatus which ejects an etching liquid such as an acid or an alkali for etching a substrate or the like, or the like.

C2. Modified Example 2

With the first working example described above, of the six surface defining the substantially solid rectangle shape of the containing box 200, one surface is the opening 202, and the containing box 200 is fixed to the flow path member 100 so that the opening 202 is blocked by the flow path member 100, but it is also possible to have it so that of the aforementioned six surfaces, two surfaces or more (five surfaces or less) are openings, and the containing box 200 is fixed to the flow path member 100 so that those openings are blocked by the flow path member 100. It is also not absolutely necessary that the containing box 200 be a substantially solid rectangle shape, and it is acceptable as long as regardless of the shape of the containing box 200, the containing box 200 has openings, and the containing box 200 is fixed to the flow path member 100 such that the openings are blocked by the flow path member 100.

C3. Modified Example 3

In the working example described above, the paper material 220 which is the material of the containing box 200 has a three layer configuration in which the polyethylene layers 222 and 226 are arranged on both sides of the paper 224, but the polyethylene layer on one or both sides of the paper material 220 may be omitted. In addition, the paper material 220 may be configured by four layers or more, which include other layers. In addition, the containing box 200 may be formed from another plant derived material (for example, a bioplastic such as polylactic acid (PLA)).

C4. Modified Example 4

With the working example described above, the ink cartridge 70 is mainly constituted by the flow path member 100, the containing box 200, and the ink containing bag 300, but it is also possible to constitute the ink cartridge 70 mainly from the flow path member 100 and the containing box 200 without equipping the ink containing bag 300. Specifically, it is possible to have the ink contained directly in the space 210 inside the containing box 200 (the space 210 is used as the ink containing space). In this case, the ink contained in the space 210 inside the containing box 200 is supplied to the print head 61 via the flow path 140 and the supply port 142 of the flow path member 100. Also, in this case, to give the containing box 200 barrier properties, it is preferable to further laminate a layer having barrier properties (e.g. a ceramic deposition film) on the paper material 220 with the three layer configuration in the working example described above. The ceramic deposition film differs from an aluminum deposition film in that it does not use metal so can be incinerated, so with this modified example as well, it is possible to reduce the environmental burden of the ink cartridge 70 during its life cycle.

C5. Modified Example 5

In the working example described above, the flexible sheet 320 which is the material of the ink containing bag 300 has a three layer configuration in which the polyethylene layers 322 and 326 are arranged on both sides of the aluminum deposition film 324, but another material (for example, a ceramic deposition film) which has a barrier property may be used instead of the aluminum deposition film 324.

C6. Modified Example 6

With the working example described above, alignment of the ink cartridge 70 with the holder 62 is made to be performed by the concave sections 170 of the flow path member 100 engaging with the convex sections 64 formed in the holder 62, but it is also possible to do the reverse and have alignment of the ink cartridge 70 with the holder 62 be performed by convex sections of the flow path member 100 engaging with concave sections formed on the holder 62. This is not limited to engagement of concave sections and convex sections, and it is also possible to form one set or a plurality of sets of engagement sections for which alignment is possible by mutually engaging the flow path member 100 and the holder 62.

C7. Modified Example 7

In the working example described above, six of the ink cartridges 70 are mounted in the holder 62, but it is sufficient if the number of the ink cartridges 70 which are able to be mounted in the holder 62 is one or more. In addition, a plurality of the ink cartridges 70, where inks with the same characteristics are contained, may be mounted in the holder 62.

C8. Modified Example 8

The configuration for fixing the containing box 200 and the flow path member 100 of the working examples described above are nothing more than examples, and various modifications are possible. For example, with the first working example shown in FIG. 9, the containing box 200 is fixed to the flow path member 100 by the protruding section 120 pinching the folding section 240 so as to compress it, but there is a gap between the flange section 122 of the protruding section 120 and the folded section 240, and when the containing box 200 and the flow path member 100 move so as to separate in relation to each other, it is also possible to have the flange section 122 of the protruding section 120 and the folded section 240 interfere so as to inhibit that kind of movement.

Also, with the first working example shown in FIG. 9, the portion to be gripped which is the fixing part of the flow path member 100 on the containing box 200 was the folded section 240, but it is also possible for the portion to be gripped to not be folded but rather to be a part for which the thickness is greater by being pasted together, and it is also possible for it to be a part for which the thickness of the paper material 220 itself is greater in parts. Also, the portion to be gripped of the containing box 200 does not absolutely have to be provided adjacent to the opening 202, and can also be provided at a portion separated from the opening 202. Also, the portion to be gripped of the containing box 200 does not absolutely have to have a greater thickness than the other parts, and can also have the same thickness as other parts, or can have a smaller thickness than the other parts.

C9. Modified Example 9

With the second working example described above, the label 180 is provided on the flow path member 100, but it is also possible to have the label 180 provided on a different high rigidity member (a member formed using a material with higher rigidity than the material of the containing box 200) from the flow path member 100. In this way as well, it is possible to achieve an improvement in the reading and writing precision of the label 180. Also, in this case, it is also possible have the high rigidity member on which the label 180 is provided coupled with the flow path member 100. By working in this way, the relative positional relationship of the high rigidity member on which the label 180 is provided and the flow path member 100 is fixed with good precision, and through the alignment of the ink cartridge 70 and the holder 62 by the flow path member 100, it is possible to improve the precision of the relative positional relationship of the label 180 and the reading unit 80 and writing unit 90, and as a result it is possible to achieve an improvement in the reading and writing precision of the label 180.

C10. Modified Example 10

With the second working example described above, the recording layer 181 of the label 180 records information using a pattern, but the recording layer 181 can also record information using text. Also, with the second working example described above, information is recorded on the label 180, but it is also possible for information to be recorded on the flow path member 100 or another high rigidity member surface by printing directly without using the label 180.

C11. Modified Example 11

With the second working example described above, among the reading unit 80 and writing unit 90 and the ink cartridge 80, by moving the ink cartridge 80, a state is formed in which the reading unit 80 and writing unit 90 are facing opposite the label 180, but by conversely having the reading unit 80 and writing unit 90 move, or by having both the reading unit and writing unit 90 and the ink cartridge 70 move, it is also possible to have a state formed in which the reading unit 80 and writing unit 90 are facing opposite the label 180.

Also, the direction of relative movement of the reading unit 80 and writing unit 90 and the ink cartridge 70 is not limited to being one direction (one dimensional direction), but can also be a two dimensional direction or three dimensional direction.

Also, with the second working example described above, the recording method of the information on the label 180 is not limited to being a method using heating, and various publicly known methods can be used. For example, it is also possible to use a material that changes color by including a designated moisture content.

Also, with the second working example described above, writing of information was performed in a state with the writing unit 90 in contact with the label 180, but it is also possible to perform writing of information in a state with the writing unit 90 not in contact with the label 180. Also, with the second working example described above, reading of information was performed in a state with the reading unit 90 not in contact with the label 180, but it is also possible to have reading of the information performed in a state with the reading unit 80 in contact with the label 180.

C12. Modified Example 12

Figure 21:
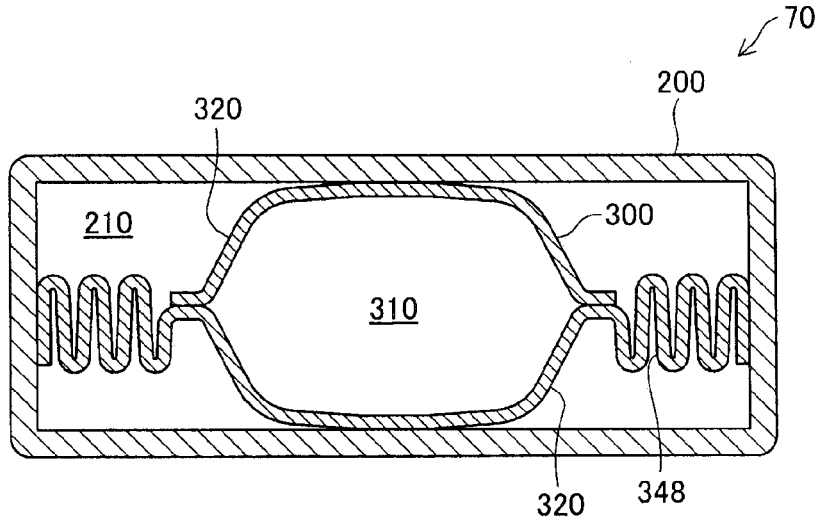
FIG. 21 is an explanatory diagram illustrating the configuration of the ink cartridge 70 of another modified example.
Figure 22:
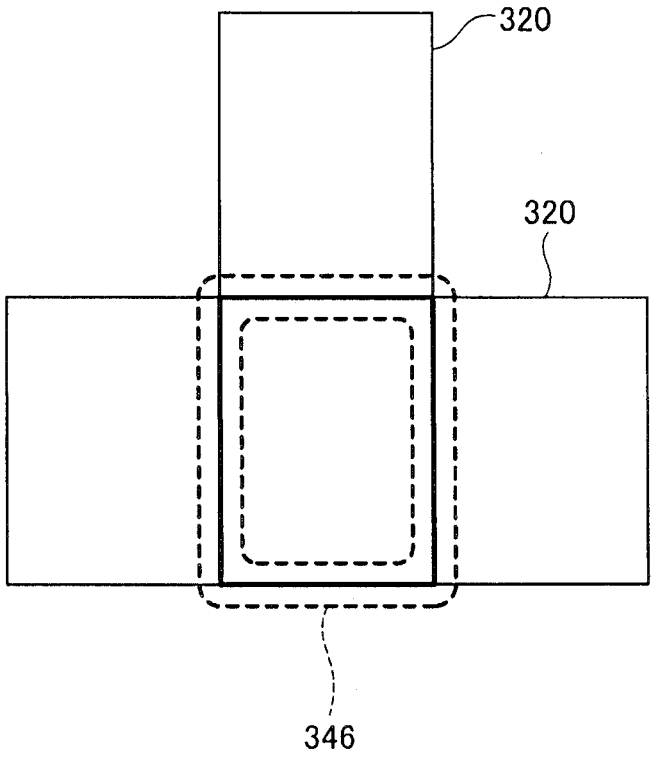
FIG. 22 is an explanatory diagram illustrating the manufacturing method of the ink containing bag 300 of the modified example in FIG. 21.

FIG. 21 is an explanatory diagram illustrating the configuration of the ink cartridge 70 of another modified example. With the ink cartridge 70 of the modified example shown in FIG. 21, the ink containing bag 300 has a shock buffering section 348. The shock buffering section 348 has a flexible sheet 220 which is the material of the ink containing bag 300 folded in accordion form, and is formed to be able to deform (expand and shrink). The shock buffering section 348 is positioned between the ink containing space 310 and the inner wall of the containing box 200 in the space 210 within the containing box 200, and functions as a buffering material for ensuring protection and stable fixing of the ink containing space 310. FIG. 22 is an explanatory diagram illustrating the manufacturing method of the ink containing bag 300 of the modified example of FIG. 21. With the manufacturing of the ink containing bag 300 of the modified example of FIG. 21, lamination is done such that two flexible sheets 320 have a portion mutually overlapping and a portion not overlapping, and the two flexible sheets 320 are adhered at the bonding section 346 which is the outer periphery of the mutually overlapping part to form a bag shaped ink containing space 310, and the part that does not overlap (the part other than the bag shaped part) is folded in accordion form to make the shock buffering section 348. FIG. 21 shows the cross section configuration of only one direction of the ink containing bag 300, but it is also possible to have the shock buffering section 348 formed on the outside of the ink containing space 310 along the other direction as well.

Here, the invention is not limited to the embodiments, working examples, and modified examples described above, and the realization of various configurations is possible in a range which does not depart from the spirit of the present invention. For example, it is possible for the technical characteristics in the embodiments, working examples, and modified examples which correspond to the technical characteristics in each of the aspects according to the Summary of the Invention section to be replaced or combined as appropriate in order to solve a portion or all of the problems described above, or in order to achieve a portion of all of the effects described above. In addition, where a technical characteristic is not described as one which is essential in the present specifications, it is able to be removed as appropriate.

What is claimed is:

1. A liquid container configured to be mounted in a liquid container holder of a liquid consuming apparatus, comprising:

a first container section enclosing at least a portion of a liquid containing space capable of containing a liquid, the material thereof including a plant derived material;

a high rigidity member having higher rigidity than the first container section, the material thereof including a material different from the plant derived material; and an information recording unit positioned above the high rigidity member, in which information relating to the liquid container is recorded, for which the information is read or written by a reading unit or a writing unit provided on the liquid consuming apparatus.

2. The liquid container according to claim 1, further comprising:

a second container section having the liquid containing space internally, formed by a flexible sheet, and enclosed by the first container section.

3. The liquid container according to claim 1, wherein the information is capable to be written to the information recording unit in a state with the writing unit in contact with the information recording unit.

4. The liquid container according to claim 1, wherein the high rigidity member is a flow path member having a supply port for supplying liquid contained in the liquid containing space to the liquid consuming apparatus, and having a flow path that links the liquid containing space and the supply port.

5. The liquid container according to claim 1, further comprising:

a flow path member having a supply port for supplying liquid contained in the liquid containing space to the liquid consuming apparatus, and having a flow path that links the liquid containing space and the supply port, wherein the flow path member is coupled to the high rigidity member.

6. The liquid container according to claim 5, wherein the liquid container includes a first surface and a second surface different from the first surface, and the high rigidity member is positioned on the first surface, and the flow path forming member is positioned on the second surface.

7. The liquid container according to claim 6, wherein the coupling part of the high rigidity member and the flow path member is thinner than the high rigidity member and the flow path member adjacent to the coupling part.

8. The liquid container according to claim 1, wherein the liquid container includes a first surface and a second surface different from the first surface, and the information recording unit is positioned at the first surface, and the first surface is exposed when the liquid container is mounted in the liquid container holder.

9. The liquid container according to claim 1, comprising:

a flow path member having a supply port for supplying liquid contained in the liquid containing space to the liquid consuming apparatus, and having a flow path that links the liquid containing space and the supply port, wherein the liquid container includes a first surface and a second surface facing opposite the first surface, and the supply port is positioned on the first surface, and the information recording unit is positioned on the second surface.

10. The liquid container according to claim 1, wherein the high rigidity member has a liquid container side engagement section that is engaged with an apparatus side engagement section provided on the liquid consuming apparatus to fix the liquid container to the liquid container holder.

11. The liquid container according to claim 1, wherein the high rigidity member has a liquid container side engagement section that is engaged with an apparatus side engagement section provided on the liquid consuming apparatus to align the liquid container with the liquid container holder.

12. A liquid container configured to be mounted in the liquid container holder of a liquid consuming apparatus, comprising:

a first container section for which the material includes a plant derived material;

a second container section having a liquid containing space internally, formed using a flexible sheet and enclosed by the first container section;

a high rigidity member having higher rigidity than the first container section, and for which the material includes a material different from the plant derived material; and an information recording unit provided on the high rigidity member, in which information relating to the liquid container is recorded, and for which the information is read or written by the reading unit or the writing unit provided on the liquid consuming apparatus, wherein the information is written to the information recording unit in a state with the writing unit in contact with the information recording unit.

13. The liquid container according to claim 12, wherein the high rigidity member is a flow path member having a supply port for supplying liquid contained in the liquid containing space to the liquid consuming apparatus, and having a flow path that links the liquid containing space and the supply port.

14. The liquid container according to claim 12, further comprising:

a flow path member having a supply port for supplying liquid contained in the liquid containing space to the liquid consuming apparatus, and having a flow path that links the liquid containing space and the supply port, wherein the flow path member is coupled with the high rigidity member.

15. The liquid container according to claim 14, wherein the liquid container includes a first surface and a second surface different from the first surface, and the high rigidity member is positioned at the first surface and the flow path forming member is positioned at the second surface.

* * * * *